US010386767B2

(12) United States Patent
Tomii

(10) Patent No.: US 10,386,767 B2
(45) Date of Patent: Aug. 20, 2019

(54) IMAGE FORMING APPARATUS AND METHOD OF CONTROLLING IMAGE FORMING APPARATUS AND DETECTING STREAKS

(71) Applicant: CANON KABUSHIKI KAISHA, Tokyo (JP)

(72) Inventor: Hiroshi Tomii, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 15/478,450

(22) Filed: Apr. 4, 2017

(65) Prior Publication Data

US 2017/0308017 A1 Oct. 26, 2017

(30) Foreign Application Priority Data

Apr. 20, 2016 (JP) ..... 2016-084761

(51) Int. Cl.
*G03G 15/00* (2006.01)

(52) U.S. Cl.
CPC ..... *G03G 15/5058* (2013.01); *G03G 15/5062* (2013.01); *G03G 15/553* (2013.01); *G03G 2215/0129* (2013.01); *G03G 2215/0164* (2013.01)

(58) Field of Classification Search
CPC ..... G03G 15/5058; G03G 15/5062; G03G 15/553
USPC ..... 399/72
See application file for complete search history.

(56) References Cited

U.S. PATENT DOCUMENTS

| | | | | |
|---|---|---|---|---|
| 8,190,039 | B2 | 5/2012 | Iida et al. | |
| 2009/0041481 | A1 | 2/2009 | Iida et al. | |
| 2015/0110505 | A1* | 4/2015 | Takahashi | G03G 15/5062 399/15 |

FOREIGN PATENT DOCUMENTS

| | | | |
|---|---|---|---|
| JP | 2009-042691 | A | 2/2009 |
| JP | 2009-063810 | A | 3/2009 |

* cited by examiner

*Primary Examiner* — David M. Gray
*Assistant Examiner* — Andrew V Do
(74) *Attorney, Agent, or Firm* — Venable LLP

(57) ABSTRACT

An image forming apparatus forms a first image by adjusting a photosensitive member potential to a first charging potential and adjusting a developing potential to a first developing potential, and forms a second image by adjusting the member potential to a second charging potential and adjusting the developing potential to a second developing potential, but not causing an exposure unit to expose a photosensitive member, and forms a third image by adjusting the developing potential to a third developing potential, but not causing a charging unit to charge the member and not causing the exposure unit to expose the member. The apparatus detects a streak image based on read data of the first, second and third images, and read data corresponding to a non-image region of the test sheet.

6 Claims, 16 Drawing Sheets

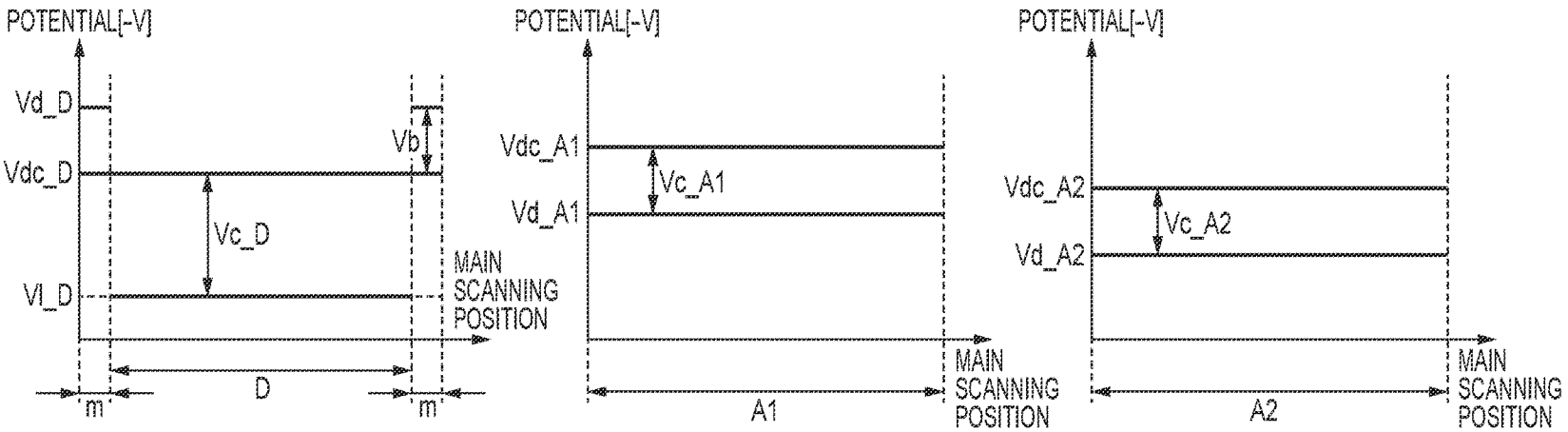
FIG. 4A
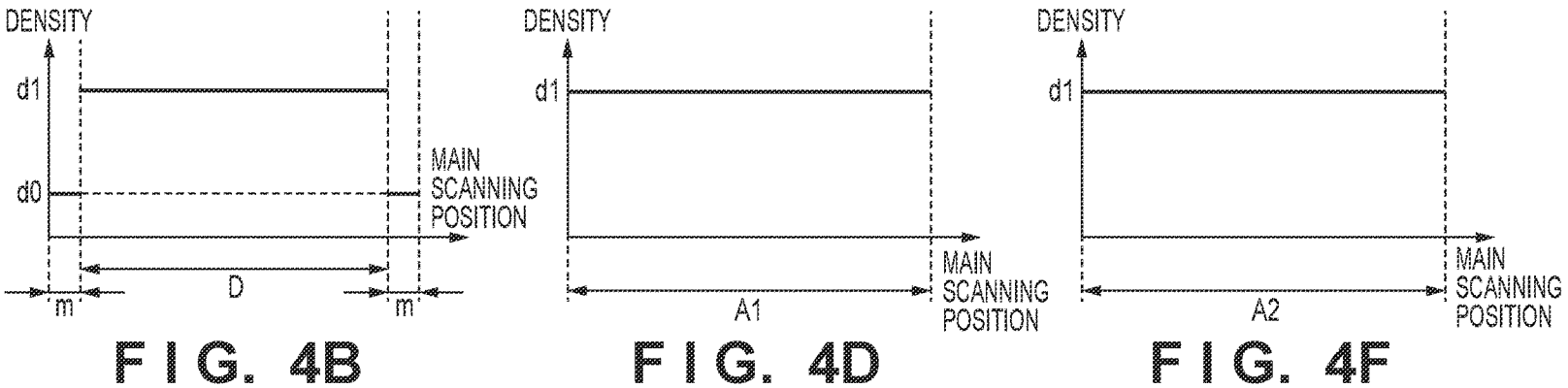
FIG. 4B
FIG. 4C
FIG. 4D
FIG. 4E
FIG. 4F

FIG. 5A

| TYPE OF STREAK | REPLACEMENT PART | WHITE BACKGROUND PART W | PATTERN IN WHICH STREAK OCCURRED | DIGITAL PATTERN | ANALOG PATTERN | EFFECT OF LOWERING THE CHARGING POTENTIAL |
|---|---|---|---|---|---|---|
| DEVELOPING COAT DEFECT STREAK | DEVELOPING UNIT OF OCCURRING COLOR | NO STREAK | ONLY OCCURRING COLOR | STREAK OCCURS | STREAK OCCURS | NO EFFECT |
| EXPOSURE DEFECT WHITE STREAK | EXPOSURE UNIT OF OCCURRING COLOR (CLEANING MAINTENANCE) | NO STREAK | ONLY OCCURRING COLOR | STREAK OCCURS | NO STREAK | NO EFFECT |
| CHARGE DEFECT STREAK | PROCESS CARTRIDGE OF OCCURRING COLOR | NO STREAK | ONLY OCCURRING COLOR | STREAK OCCURS | STREAK OCCURS | STREAK IMPROVED |
| BELT PLASTICITY DEFORMATION STREAK | INTERMEDIATE TRANSFER UNIT | NO STREAK | ALL COLORS | STREAK OCCURS | STREAK OCCURS | NO EFFECT |
| DRUM CLEANING DEFECT STREAK | PROCESS CARTRIDGE OF OCCURRING COLOR | STREAK OCCURS (SOLID COLOR) | ALL COLORS | STREAK OCCURS | STREAK OCCURS | NO EFFECT |
| BELT CLEANING DEFECT STREAK | TRANSFER BELT CLEANER | STREAK OCCURS (MIXED COLOR) | ALL COLORS | STREAK OCCURS | STREAK OCCURS | NO EFFECT |

FIG. 5B

| TYPE OF STREAK | REPLACEMENT PART | WHITE BACKGROUND PART W | PATTERN IN WHICH STREAK OCCURRED | DIGITAL PATTERN | ANALOG PATTERN (WITH CHARGE) | ANALOG PATTERN (WITHOUT CHARGE) |
|---|---|---|---|---|---|---|
| DEVELOPING COAT DEFECT STREAK | DEVELOPING UNIT OF OCCURRING COLOR | NO STREAK | ONLY OCCURRING COLOR | STREAK OCCURS | STREAK OCCURS | STREAK OCCURS |
| EXPOSURE DEFECT WHITE STREAK | EXPOSURE UNIT OF OCCURRING COLOR (CLEANING MAINTENANCE) | NO STREAK | ONLY OCCURRING COLOR | STREAK OCCURS | NO STREAK | NO STREAK |
| CHARGE DEFECT STREAK | PROCESS CARTRIDGE OF OCCURRING COLOR | NO STREAK | ONLY OCCURRING COLOR | STREAK OCCURS | STREAK OCCURS | NO STREAK |
| TRANSFER BELT PLASTICITY DEFORMATION STREAK | INTERMEDIATE TRANSFER UNIT | NO STREAK | ALL COLORS | STREAK OCCURS | STREAK OCCURS | STREAK OCCURS |
| DRUM CLEANING DEFECT STREAK | PROCESS CARTRIDGE OF OCCURRING COLOR | STREAK OCCURS (SOLID COLOR) | ALL COLORS | STREAK OCCURS | STREAK OCCURS | STREAK OCCURS |
| TRANSFER BELT CLEANING DEFECT STREAK | TRANSFER BELT CLEANER | STREAK OCCURS (MIXED COLOR) | ALL COLORS | STREAK OCCURS | STREAK OCCURS | STREAK OCCURS |

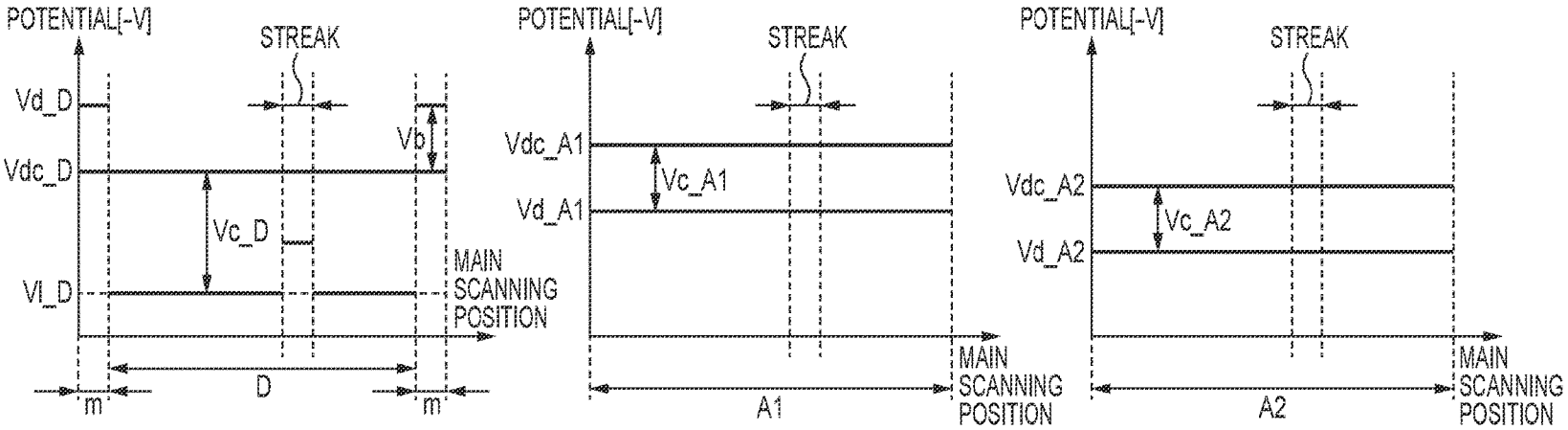
FIG. 9A
FIG. 9C
FIG. 9E
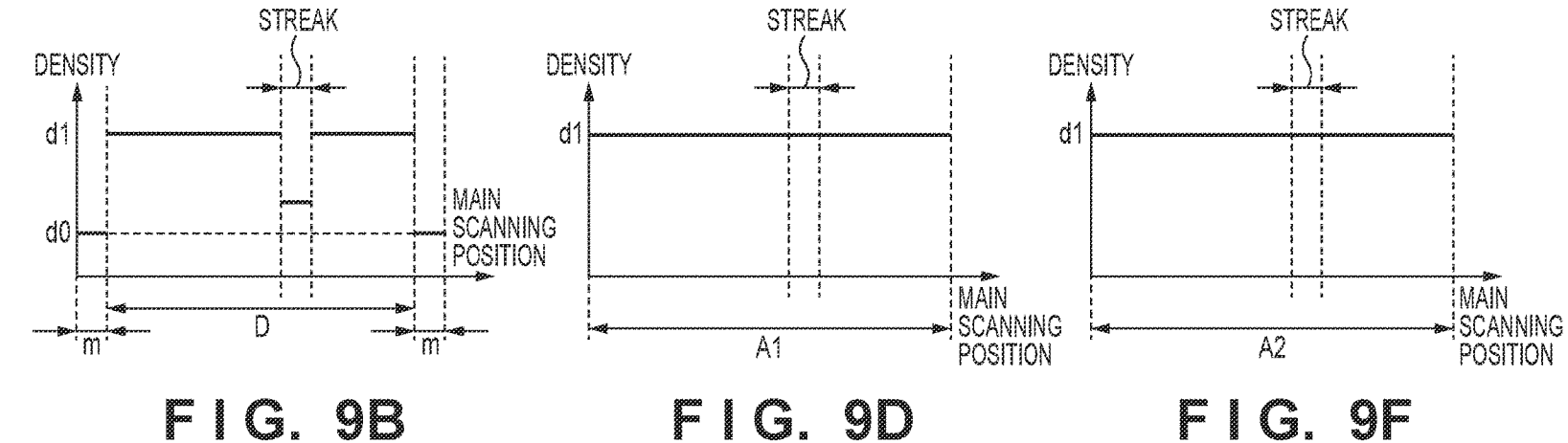
FIG. 9B
FIG. 9D
FIG. 9F

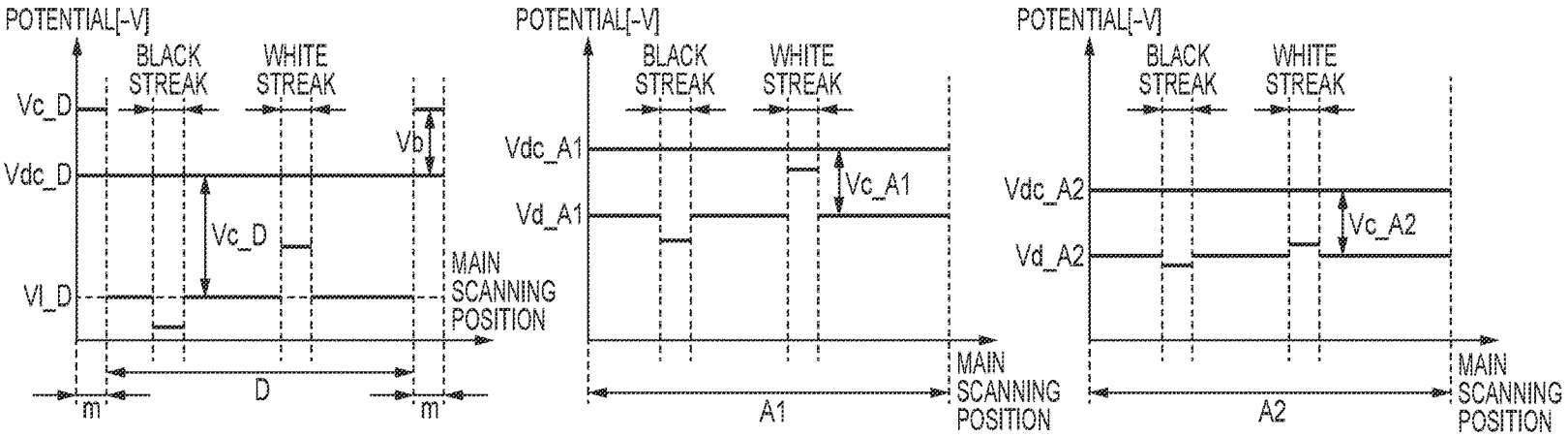
FIG. 11A
FIG. 11C
FIG. 11E
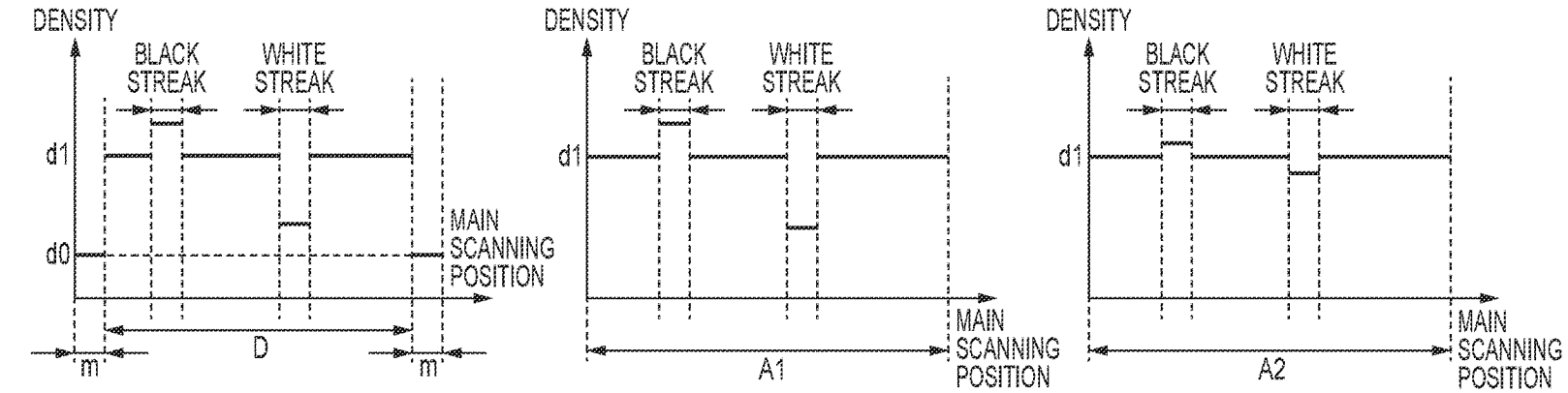
FIG. 11B
FIG. 11D
FIG. 11F

IMAGE FORMING APPARATUS AND METHOD OF CONTROLLING IMAGE FORMING APPARATUS AND DETECTING STREAKS

BACKGROUND OF THE INVENTION

Field of the Invention

The present invention relates to an image forming apparatus and a method of controlling an image forming apparatus.

Description of the Related Art

An electrophotographic image forming apparatus has various parts that can be replaced, such as a charging unit, an exposure unit, and a developer. A user or a serviceman determines whether to replace with a replacement part (a consumable part) by visually observing an output image, but such a determination is difficult. If it takes time to make the replacement part assessment, the time in which a user cannot form an image (so-called downtime) becomes longer.

According to US2009/0041481, it is recited that a yellow pattern, a magenta pattern, a cyan pattern, and a black pattern are formed, and it is reported that a replacement of a processing unit that formed a color pattern in which an abnormality occurred is required. Because a photosensitive drum, a charging unit, a developer, and a cleaning unit are integrated in a processing unit, these parts are replaced together. By Japanese Patent Laid-Open No. 2009-63810, an image forming apparatus that determines whether the cause of an image error is an exposure unit or a charging unit by forming a test image in a state in which there is no exposure and in a state in which there is an exposure is proposed.

In US2009/0041481 it is identified which color processing unit should be replaced, but the charging unit and the developer cannot be replaced individually. That is, in US2009/0041481, it cannot be identified which of the charging unit and the developer should be replaced. In Japanese Patent Laid-Open No. 2009-63810, it is possible to identify which of the exposure unit and the charging unit should be replaced, but it cannot be identified which of the charging unit and the developer should be replaced.

SUMMARY OF THE INVENTION

Accordingly, the present invention provides an image forming apparatus that forms a test image by which it is possible to identify which of a charging unit and a developer unit should be replaced.

The present invention provides an image forming apparatus comprising a photosensitive member, a charging unit configured to charge the photosensitive member, an exposure unit configured to expose the photosensitive member, which is charged by the charging unit, to form an electrostatic latent image, a developer unit configured to develop the electrostatic latent image on the photosensitive member, using a developer, to form an image, an intermediate transfer body to which the image on the photosensitive member is transferred, a transfer unit configured to transfer the image on the intermediate transfer body to a sheet, a first removing unit configured to remove developer remaining on the photosensitive member, a second removing unit configured to remove developer remaining on the intermediate transfer body, and a controller configured to output a test sheet on which a test image is formed by controlling the photosensitive member, the charging unit, the exposure unit, the developer unit, and the transfer unit, to obtain read data related to the test sheet, and to detect a streak image included in the test sheet based on the read data. The read data is outputted from a reading device. The test image includes a first test image, a second test image, and a third test image. The controller, in a case where the first test image is formed, controls the charging unit to adjust a potential of the photosensitive member to a first charging potential, controls the exposure unit to form an electrostatic latent image corresponding to the first test image, and controls the developing unit to adjust a potential of the developer unit to a first developing potential. The controller, in a case where the second test image is formed, controls the charging unit to adjust the potential of the photosensitive member to a second charging potential, but does not cause the exposure unit to expose the photosensitive member, and controls the developer unit to adjust the potential of the developer unit to a second developing potential. The controller, in a case where the third test image is formed, controls the developer unit to adjust the potential of the developer unit to a third developing potential, but does not cause the charging unit to charge the photosensitive member, and does not cause the exposure unit to expose the photosensitive member. The controller detects the streak image based on first read data corresponding to the first test image, second read data corresponding to the second test image, third read data corresponding to the third test image, and fourth read data corresponding to a non-image region of the test sheet.

Further features of the present invention will become apparent from the following description of exemplary embodiments (with reference to the attached drawings).

BRIEF DESCRIPTION OF THE DRAWINGS

FIGS. 4A to 4F are views for describing relations among streaks, charging potential, and developing potential.

FIGS. 5A and 5B are views describing relations between types of streaks and replacement parts.

FIGS. 9A to 9F are views for describing relations among streaks, charging potential, and developing potential.

FIGS. 11A to 11F are views for describing relations among streaks, charging potential, and developing potential.

DESCRIPTION OF THE EMBODIMENTS

[Image Forming Apparatus]

Figure 1:
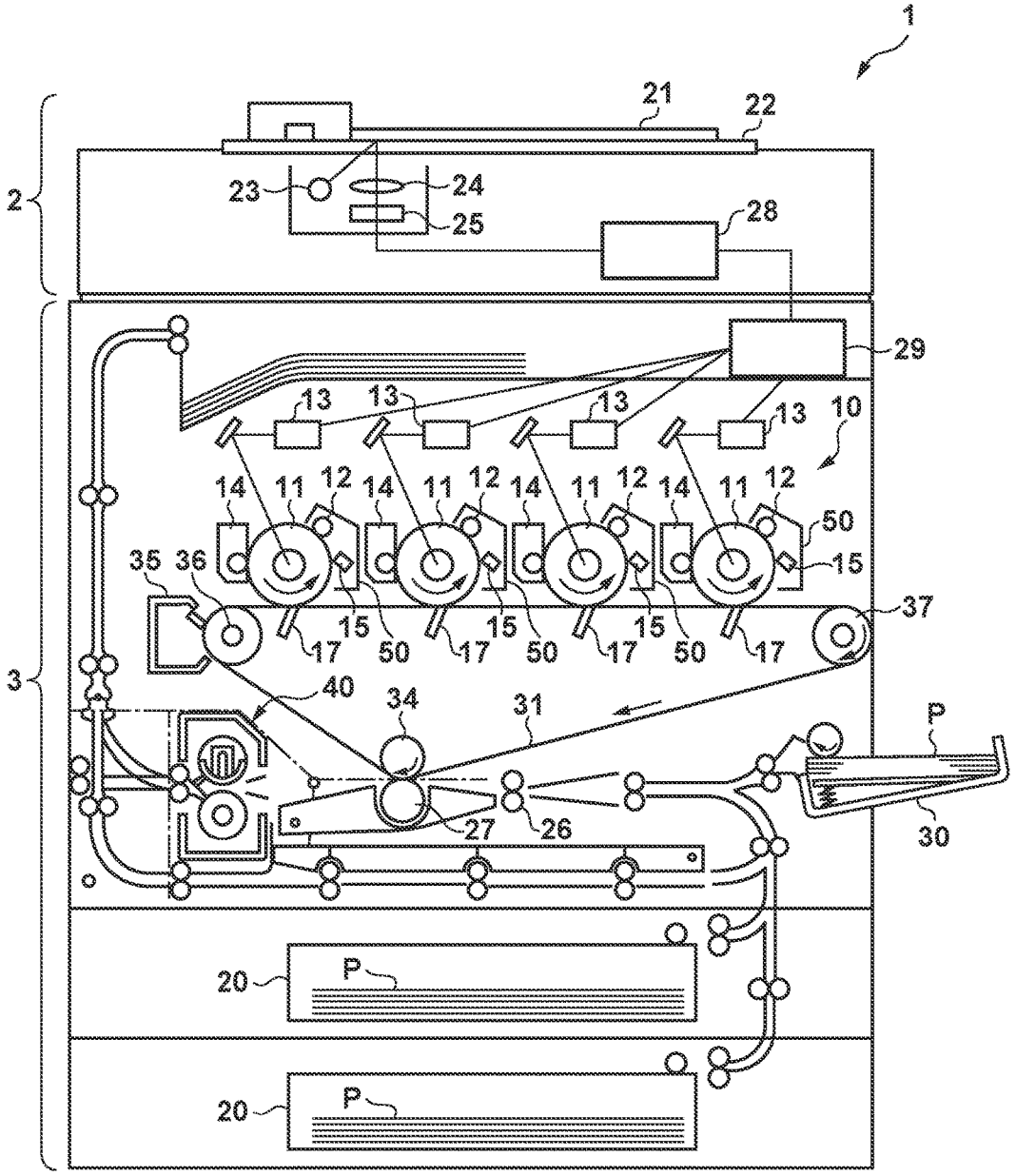
FIG. 1 is a view for describing an image forming apparatus.

FIG. 1 is a cross-sectional view for describing an image forming apparatus 1. The image forming apparatus 1 has an image reader 2 and a printer 3. The image reader 2 is a reading unit for reading an original, a test chart or the like. A light source 23 irradiates light on an original 21 placed on a platen glass 22. An optical system 24 guides a reflected light from the original 21 to a CCD sensor 25 causing an image to be formed. CCD is an abbreviation for charge-coupled device. The CCD sensor 25 has red, green, and blue line sensors, and generates red, green, and blue color component signals. An image processing unit 28 executes image processing (example: shading correction or the like) on an image signal obtained by the CCD sensor 25, and outputs it to a printer control unit 29 of the printer 3.

An image forming unit 10 of the printer 3 is an electrophotographic image forming engine that forms a toner image in accordance with image information on a sheet P. The image forming unit 10 has four stations that form toner images of each of Y (yellow), M (magenta), C (cyan), and Bk (black) colors. Note that the present invention can be applied to a monochrome printer that forms a solid color image. As FIG. 1 illustrates, the image forming unit 10 comprises four of a photosensitive drum 11 corresponding to each of the colors Y, M, C, and Bk in order from the left side to the right. In the periphery of each of the photosensitive drum 11 are arranged a roller shape charger unit 12, an exposure unit 13, a developing unit 14, a primary transfer unit 17, a drum cleaner 15 and the like. Below, a procedure for forming a Bk color toner image is described to represent all four colors. The procedure for forming a toner image of the other colors is similar.

When image formation is started, the photosensitive drum 11 rotates in the arrow symbol direction. The charger unit 12 causes a front surface of the photosensitive drum 11 to be charged uniformly. The exposure unit 13 forms an electrostatic latent image by exposing the front surface of the photosensitive drum 11 in accordance with image information outputted by the printer control unit 29. The developing unit 14 forms a toner image by developing by causing toner to adhere to the electrostatic latent image. The primary transfer unit 17 primary transfers the toner image, which is carried to the photosensitive drum 11, to an intermediate transfer belt 31. The intermediate transfer belt stretches over three rollers 34, 36, and 37. The drum cleaner 15 removes toner that remains on the photosensitive drum 11. By this, the photosensitive drum 11 enters a state in which it is able to form the next image.

Meanwhile, a registration roller pair 26 first stops the sheet P after it has been fed from a feeding cassette 20 or a multi-feed tray 30, and performs skew correction so that the sheet P is parallel to the conveyance direction. Furthermore, the registration roller pair 26, in synchronization with the toner image on the intermediate transfer belt 31, feeds the sheet P between the intermediate transfer belt 31 and a secondary transfer unit 27. The secondary transfer unit 27 secondary transfers the toner image that is on the intermediate transfer belt 31 to the sheet P. A transfer cleaner 35 removes the toner remaining on the intermediate transfer belt 31. By this, the intermediate transfer belt 31 enters a state in which it is able to form the next image. A fixing device 40 causes the toner image to be fixed to the sheet P. The photosensitive drum 11, the charger unit 12, and the drum cleaner 15 are integrated as a process cartridge 50.

[Charging Scheme]

Here, the charger unit 12 is described in detail. In general, there are two types of charging schemes: a non-contact charging scheme and a contact charging scheme. The non-contact charging scheme is a scheme that realizes charging by a corona discharge produced by applying a high voltage to a metal wire or the like. However, the corona discharge causes a discharge product such as ozone, nitrogen oxide (NOx) or the like to be generated, and becomes the cause of degradation of the photosensitive drum 11 and image blurring. Also, when a discharge product adheres to a metal wire, non-uniformity of discharge may occur and a charge defect may occur in the image. Accordingly, there is a requirement that a metal wire be cleaned by a cleaner member or the like periodically. The contact charging scheme is a scheme in which charge processing is performed by causing a charging member of the charger unit 12 to contact the photosensitive drum 11. In general, the applied voltage in the contact charging scheme is lower than in the non-contact charging scheme, and the occurrence of a discharge product such as ozone or nitrogen oxide (NOx) is very low. However, a charge defect may occur when toner or a toner additive agent that slipped past the drum cleaner 15 adheres or fuses to the charging member.

[Replacement Part]

In the present embodiment, the photosensitive drum 11, the charger unit 12, and the drum cleaner 15 are integrated as the process cartridge 50. By replacing the process cartridge 50, it becomes possible to quickly replace the photosensitive drum 11, the charger unit 12, and the drum cleaner 15. Miniaturization of the charger unit 12 is possible in the contact charging scheme more than in the non-contact charging scheme. In the present embodiment, the contact charging scheme is employed because the charger unit 12 is integrated in the process cartridge 50. In the present embodiment, the developing unit 14 can be easily attached/released in relation to the image forming apparatus 1. In the present embodiment, at least the primary transfer unit 17 and the intermediate transfer belt 31 form a transfer unit. The transfer unit is also a configuration that can be easily attached/released in relation to the image forming apparatus 1. Accordingly, it is possible to quickly replace the primary transfer unit 17 and the intermediate transfer belt 31 by replacing the transfer unit. In this way, by making the process cartridge 50, the developing unit 14, and the transfer unit replacement parts, simplification of maintenance by a user and by a serviceman, and shortening of the maintenance time is realized. The transfer cleaner 35 can also be easily attached/released in relation to the image forming apparatus 1.

[Developer]

The developer used in the present embodiment is a two-component developer configured by a non-magnetic toner and a low-magnetization, high-resistance carrier. The non-magnetic toner is configured by employing an appropriate amount of a binder resin such as a styrene type resin, a polyester resin, or the like, a colorant such as carbon black, a dye or pigment, a release agent such as a wax, a charge-controlling agent and the like. Such a non-magnetic toner is manufactured by a pulverization method, a polymerization method or the like. Something that is known may be used for a magnetic carrier. For example, a resin carrier formed by, in a resin, dispersing magnetite as a magnetic material and dispersing carbon black for conductivity and resistance adjustment may be used. Also, something for which a front surface of magnetite alone of ferrite or the like is oxidized, and resistance adjustment is performed by reduction processing may be used. Also, something that is coated with a front surface resin of magnetite alone of ferrite or the like, and for which resistance adjustment is performed may be used.

[Control System]

Figure 2:
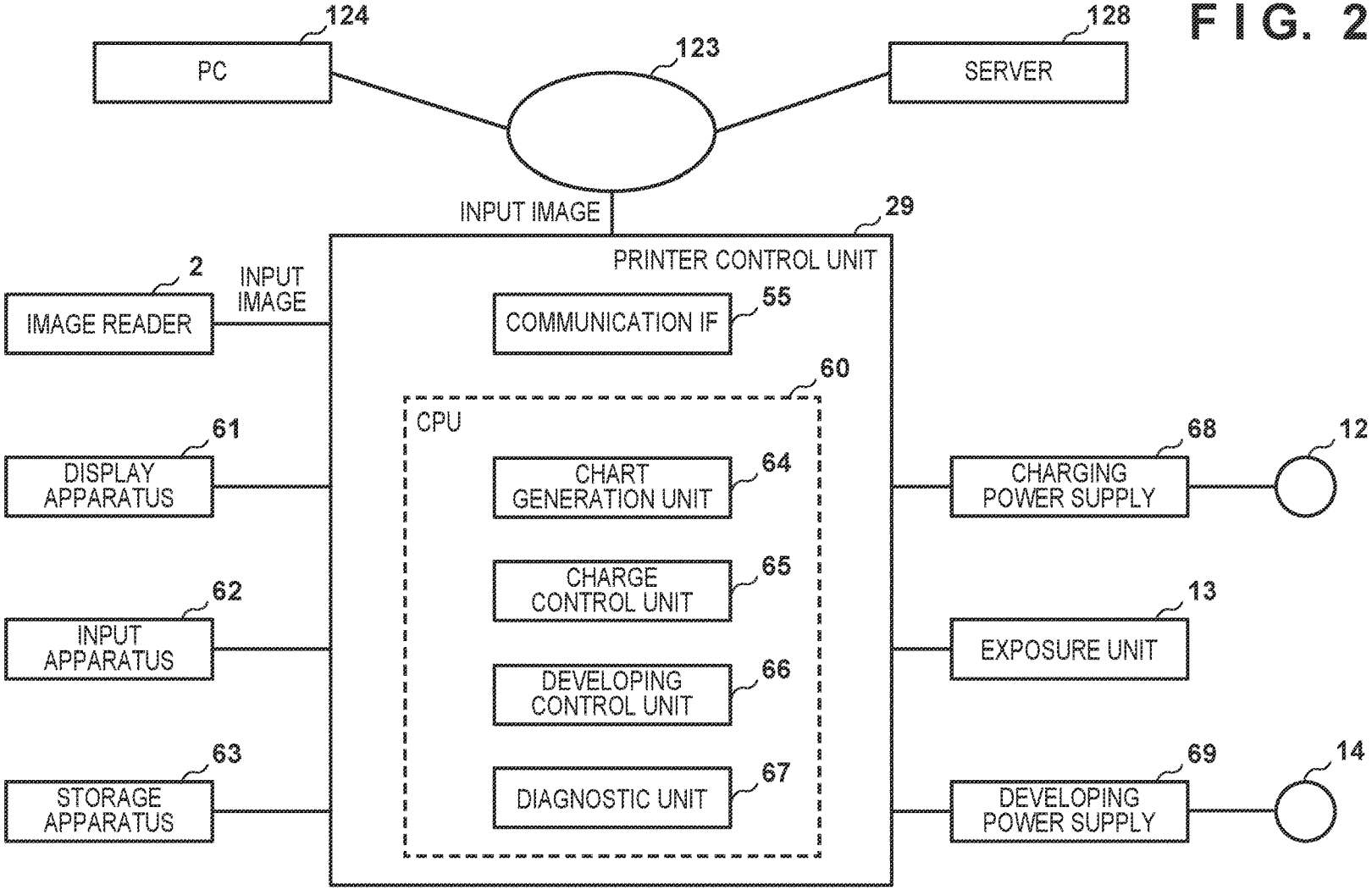
FIG. 2 is a view for describing a control system.

FIG. 2 illustrates a control system of the image forming apparatus 1. The image forming apparatus 1 is connected to a network device such as a PC 124 or a server 128 via a network 123. PC is an abbreviation for personal computer. The server 128 is a computer, a mail server or the like of a service company that is responsible for the maintenance of the image forming apparatus 1, for example. The printer control unit 29 is a controller that controls the image reader 2 and the printer 3. The printer control unit 29 may be divided between a printer controller that is responsible for image processing or the like and engine control that controls the image forming unit 10 or the like. A communication IF 55 is a communication circuit that receives print data from the PC 124 or the like, and transmits various messages from the image forming apparatus 1 to the PC 124 or the server 128. IF is an abbreviation of interface. A CPU 60 is a control circuit and a computation circuit that comprehensively controls each unit of the image forming apparatus 1. The CPU 60 realizes each kind of function by executing control programs stored in a storage apparatus 63. Note that some or all of the functions of the CPU 60 may be realized by hardware such as an ASIC, an FPGA or the like. ASIC is an abbreviation for application specific integrated circuit. FPGA is an abbreviation for field-programmable gate array. A display apparatus 61 is a unit for displaying various information. An input apparatus 62 is a unit for accepting input of various information. The storage apparatus 63 is a memory such as a ROM or a RAM, and encompasses a bulk storage unit such as a hard disk drive. The CPU 60 converts image data inputted from the image reader 2 or the like into image data of a YMCK format, and further executes tone correction or the like to generate an image signal, and outputs it to the exposure unit 13.

The CPU 60 realizes various functions, but here representative functions involved in the present embodiment are described. A chart generation unit 64 controls the printer 3 to form a test image for identifying a replacement part on a sheet P. The test image itself or a sheet P on which the test image is formed is called a test chart or simply a chart. A charge control unit 65 causes a charging power supply 68 to generate a charge voltage that is applied to the charger unit 12. A developing control unit 66 causes a developing power supply 69 to generate a developing voltage that is applied to the developing unit 14. A diagnostic unit 67 identifies a replacement part based on a result of reading the chart read in by the image reader 2. Note that the diagnostic unit 67 may be omitted if a user or serviceman identifies the replacement part by visually observing the chart.

[Chart]

There are cases in which a vertical streak occurs in an image if the process cartridge 50 and the developing unit 14 reach a replacement time. A vertical streak is an image of a straight line form that extends in parallel to a conveyance direction of the sheet P. Conventionally, it has been possible to distinguish whether the cause of a streak is in the exposure unit 13 or in the charger unit 12, but it was not possible to distinguish whether it was in the charger unit 12 or the developing unit 14. Accordingly, the present embodiment provides a chart by which it is possible to identify which of the charger unit 12 and the developing unit 14 should be replaced. The replacement part is identified by a user or a serviceman visually observing the chart or by reading by the image reader 2. In particular, the chart of the present embodiment is characterized in that it includes a plurality of analog patterns formed under a plurality of conditions for image forming whose respective image carrier charging potentials differ.

In the present embodiment, an A3 size (297 mm width direction length, 420 mm conveyance-direction length) is employed as the size of the chart, but this is merely an example. When the maximum size at which paper can be fed to the image forming apparatus 1 is selected, a streak occurring on an edge in a sub scanning direction in the charger unit 12 or the developing unit 14, for example, can be detected. In this way, if the maximum size sheet that can be printed in the image forming apparatus 1 is employed, it should be possible to identify the replacement part with good precision. Note that the number of charts may be 1, and it may be plural.

Figure 3:
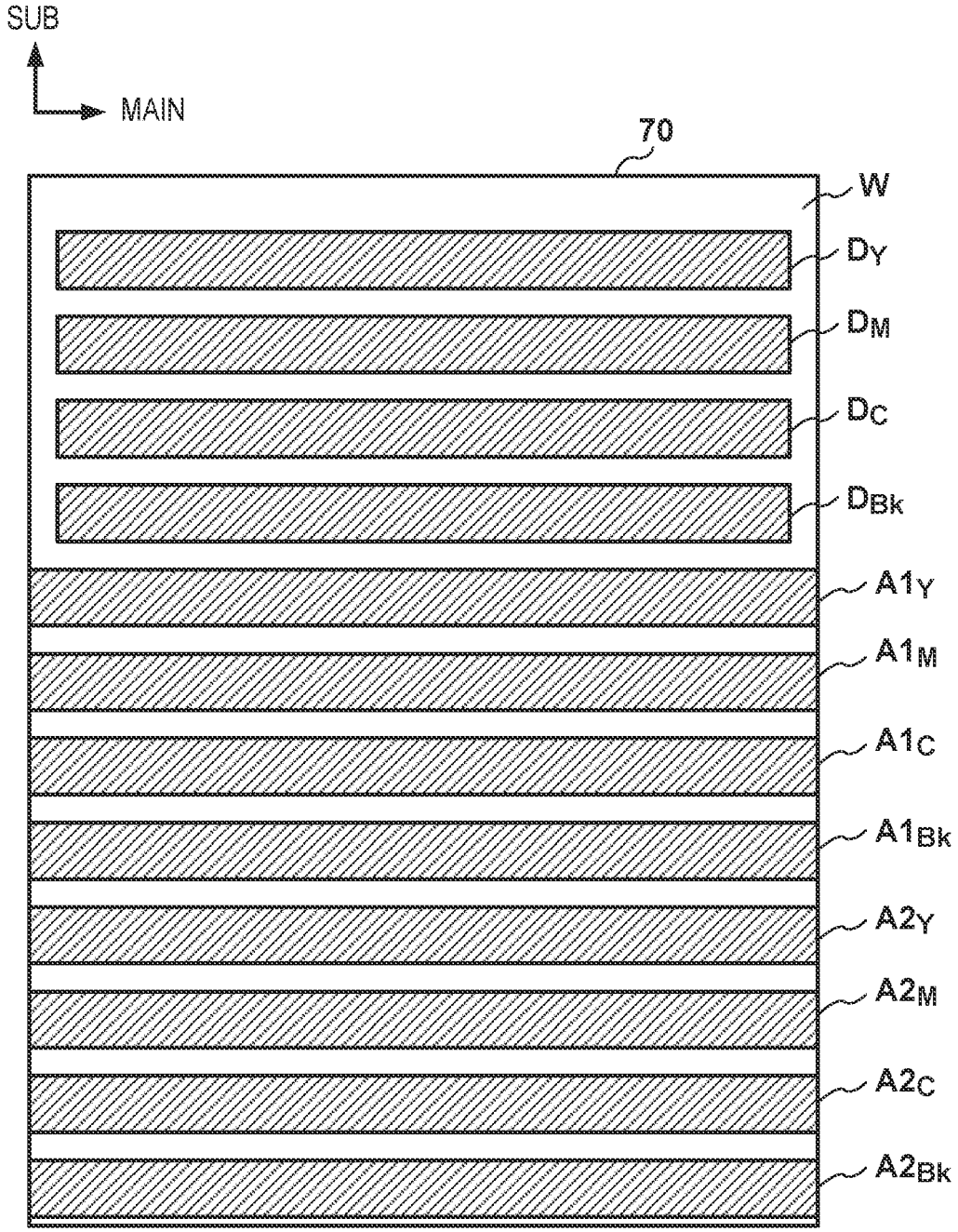
FIG. 3 is a view for describing a chart.

FIG. 3 illustrates an exemplary chart 70. A white background region W in which an image pattern is not formed, digital patterns D, and two types of analog patterns A1 and A2 are included in the chart 70. Note that YMCK added to the end of reference codes indicates the color of the toner used to form each pattern. The color of toner used when forming each pattern is monochrome, and one of the colors of YMCK. This is to identify what color station the part that should be replaced is in. The length in the conveyance direction of each pattern is, for example, approximately 30 mm. This is because detection of a vertical streak is possible if the length of the pattern is approximately 30 mm or more. Note that it is assumed that the external diameter of the photosensitive drum 11 is 30 mm, and the outer circumference thereof is approximately 94.2 mm.

The length of the main scanning direction of the digital patterns D is somewhat shorter than the length of the entire region on which an image can be formed by the image forming apparatus 1, and a margin region is arranged on both ends of the main scanning direction of the digital pattern D. Meanwhile, the length of the main scanning direction of the analog patterns A1 and A2 is the same as the length of the main scanning direction of the sheet P, and no margin is formed.

As FIG. 3 illustrates, four of the digital pattern D are exposure images (toner images) formed by exposure by the exposure unit 13. The analog pattern A1 is a non-exposure image (toner image) formed by the charging potential of the photosensitive drum 11 by the charger unit 12 being set to a first charging potential without exposure by the exposure unit 13 being executed. The analog pattern A2 is a non-exposure image (toner image) formed by the charging potential of the photosensitive drum 11 by the charger unit 12 being set to a second charging potential which is lower than the first charging potential without exposure by the exposure unit 13 being executed. Note that the terms "high" and "low" here mean high or low potential in absolute value. The manner in which a streak caused by the charger unit 12 and a streak caused by the developing unit 14 appear differs between the analog pattern A1 and the analog pattern A2. That is, if a streak occurring in the analog pattern A1 and a streak occurring in the analog pattern A2 are compared, it is possible to distinguish whether the cause of the streak is in the charger unit 12 or the developing unit 14.

FIG. 4A illustrates a potential at each main scanning position on the photosensitive drum 11 that is charged by the charger unit 12 when forming the digital pattern D. FIG. 4B illustrates a density d1 of the digital pattern D formed on the sheet P and a density d0 of the white background part W (non-image region). The density d0 is an optical density of an undercolor (white background) of the sheet P.

The charge control unit 65 causes the charger unit 12 to charge the photosensitive drum 11 by controlling the charging power supply 68 so that the charging potential in the front surface of the photosensitive drum 11 becomes Vd_D. The exposure unit 13 exposes the front surface of the photosensitive drum 11 in accordance with the image data generated by the chart generation unit 64. The result of this is that the potential of the part that is exposed in the front surface of the photosensitive drum 11 changes to Vl_D. The developing control unit 66 controls the developing power supply 69 so that the potential of the developing sleeve of the developing unit 14 becomes a direct current potential Vdc_D which is a developing bias. Vdc_D is set between the charging potential Vd_D and the potential Vl_D of the exposure unit. The margin m arranged on both ends of the digital pattern D is not exposed. Therefore, the potential of the margin m is maintained at Vd_D. In this way, a fogging voltage Vb in the margin m which is a non-exposed part is formed. Toner does not adhere to the margin m by the fogging voltage Vb. The image signal value of the digital pattern D is set to 50%. This corresponds to an image of 0.6 in optical density (that is, d1=0.6). This is because the precision of detection of a vertical streak becomes higher with such a halftone pattern than with a solid pattern.

FIG. 4C illustrates a potential at each main scanning position on the photosensitive drum 11 that is charged by the charger unit 12 when forming the first analog pattern A1. FIG. 4D illustrates the density d1 of the analog pattern A1 formed on the sheet P. The charge control unit 65 adjusts the potential of the front surface of the photosensitive drum 11 to the charging potential Vd_A1 by controlling the charging power supply 68 in accordance with an instruction from the chart generation unit 64 so as to form the analog pattern A1. The developing control unit 66 adjusts the potential of the developing sleeve of the developing unit 14 to the developing bias Vdc_A1 by controlling the developing power supply 69 in accordance with an instruction from the chart generation unit 64. The developing bias Vdc_A1 is a developing potential that is higher than the charging potential Vd_A1. Note that the chart generation unit 64 does not cause the exposure unit 13 to irradiate a laser beam. By this, the developing voltage Vc_A1 is formed as an electric potential difference between the photosensitive drum 11 and the developing sleeve. That is, an electrostatic latent image corresponding to the analog pattern A1 is formed, and a toner image is formed on the photosensitive drum 11 by the toner supplied from the developing unit 14. As FIG. 4C illustrates, a developing voltage Vc_A1 which is fixed and independent of the main scanning position is formed because exposure is not applied in the analog pattern A1. Accordingly, the margins are not formed on the two ends of the analog pattern A1. Also, it is impossible to perform halftone processing because exposure is not applied. Accordingly, in the present embodiment, the developing control unit 66 adjusts the developing voltage Vc_A1 by controlling the developing power supply 69 so that the optical density of each color of the analog pattern A1 becomes 0.6. As FIG. 4D illustrates, the analog pattern A1 of the optical density d1 (=0.6) is formed on the sheet P.

FIG. 4E illustrates a potential at each main scanning position on the photosensitive drum 11 that is charged by the charger unit 12 when forming the second analog pattern A2. FIG. 4F illustrates the density d1 of the analog pattern A2 formed on the sheet P. The charge control unit 65 adjusts the potential of the front surface of the photosensitive drum 11 to the charging potential Vd_A2 by controlling the charging power supply 68 in accordance with an instruction from the chart generation unit 64 so as to form the analog pattern A2. The developing control unit 66 adjusts the potential of the developing sleeve of the developing unit 14 to the developing bias Vdc_A2 by controlling the developing power supply 69 in accordance with an instruction from the chart generation unit 64. The developing bias Vdc_A2 is a potential that is higher than the charging potential Vd_A2. Note that the chart generation unit 64 does not cause the exposure unit 13 to irradiate a laser beam. By this, the developing voltage Vc_A2 is formed between the photosensitive drum 11 and the developing sleeve. That is, an electrostatic latent image corresponding to the analog pattern A2 is formed, and a toner image is formed on the photosensitive drum 11 by the toner supplied from the developing unit 14. As FIG. 4E illustrates, a developing voltage Vc_A2 which is fixed and independent of the main scanning position is formed because exposure is not applied in the analog pattern A2. Accordingly, the margins are not formed on both ends of the analog pattern A2. Also, it is impossible to perform halftone processing because exposure is not applied. Accordingly, in the present embodiment, the developing control unit 66 adjusts the developing voltage Vc_A2 by controlling the developing power supply 69 so that the optical density of each color of the analog pattern A2 becomes 0.6. As FIG. 4F illustrates, the analog pattern A2 of the optical density d1 (=0.6) is formed on the sheet P.

Here, a second charging potential Vd_A2 for forming the analog pattern A2 is set to be lower than the charging potential Vd_A1 for forming the analog pattern A1 (|Vd_A1|>|Vd_A2|). The result of this is that compared to the analog pattern A1, a contribution of the charger unit 12 in relation to the image error is reduced in the analog pattern A2. Note that the developing control unit 66 adjusts the developing voltage Vc_A2 so as to be the same as the developing voltage Vc_A1 by controlling the developing power supply 69. By this, the optical density of each color of the analog pattern A2 becomes 0.6.

Note that if the non-contact charging scheme is used, the charging potential of the photosensitive drum 11 is adjusted by changing the amount of current that the charging power supply 68 distributes to the metal wire. By this, the analog pattern A1 and the analog pattern A2 are formed by a non-contact charging scheme as well.

[Vertical Streak]

Using FIG. 5A, a vertical streak which is one type of image error that occurs in the image forming apparatus 1 of the present embodiment is described. FIG. 5A illustrates the type of vertical streak, the replacement part or response method, the status of the white background part, the color of the pattern in which the streak occurred, the existence or absence of a streak occurrence in a digital pattern and an analog pattern respectively, and the effect of lowering the charging potential in the analog pattern. Note that a streak for which the density has become lower than in a normal part where there is no streak is called a white streak (pale streak). The streak for which the density has become higher than a normal part is called a black streak (deep streak).

A Streak Caused by a Developing Coat Defect

Figure 6A:
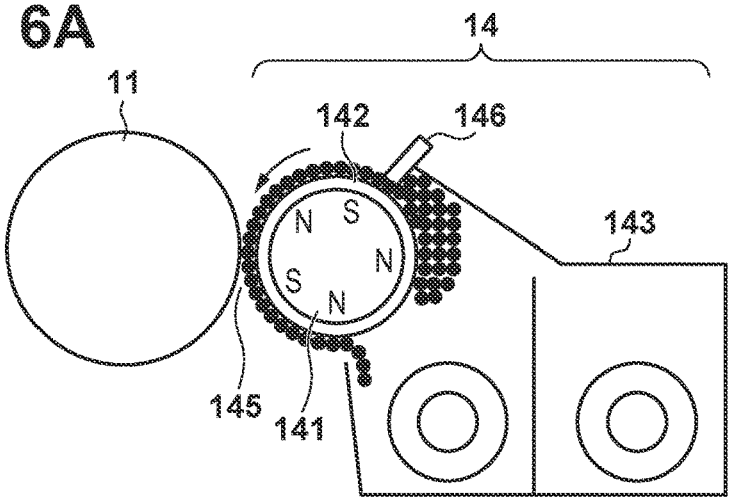
FIGS. 6A and 6C are views for describing developing coat defects.
Figure 6B:
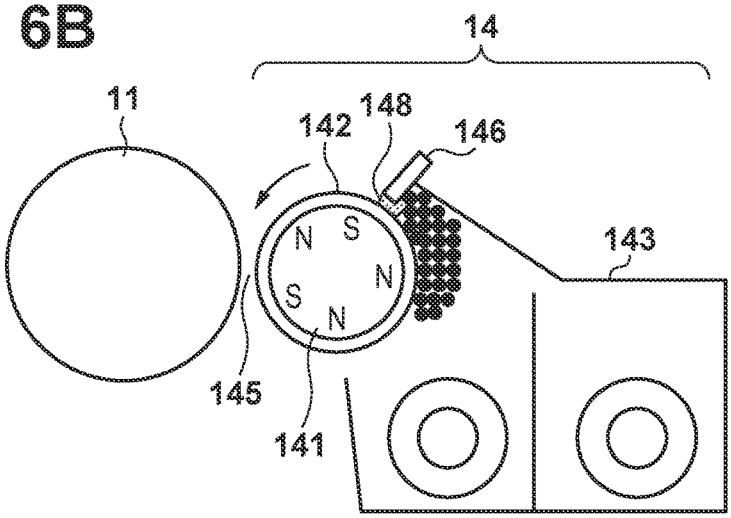

A developing coat defect streak that FIG. 5A illustrates is a vertical streak that occurs when the developing coat is insufficient. FIG. 6A and FIG. 6B are views for describing the factors in a streak caused by a developing coat defect occurring. The developing coat means that a developer is caused to adhere to the front surface of a developing sleeve 142 at a uniform thickness. A magnet 141 functioning as a developer carrier is arranged inside the developing sleeve 142. The developing sleeve 142 is supported by a developing container 143 to be able to rotate freely. A closest part 145 is a part at which the distance between the developing sleeve 142 and the photosensitive drum 11 is the closest. In the rotation direction of the developing sleeve 142, a regulation blade 146 is arranged upstream of the closest part 145. The regulation blade 146 is arranged so that the distance in relation to the developing sleeve 142 is fixed, and regulates the amount of two-component developer supplied to the closest part 145.

Figure 6C:
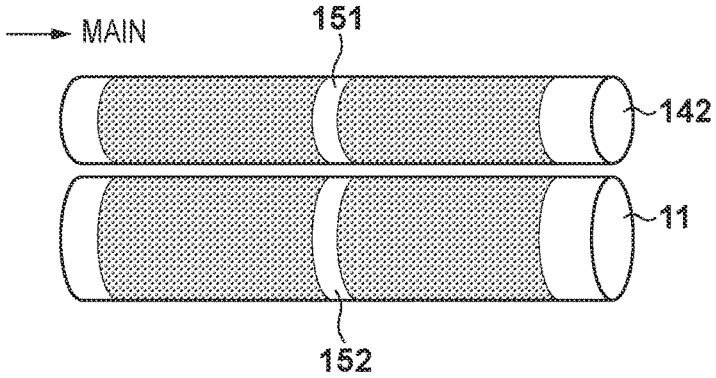

As FIG. 6B illustrates, there are cases in which a foreign particle 148 such as dust or a hair is clogged between the developing sleeve 142 and the regulation blade 146. In such a case, the foreign particle 148 impairs the flow of developer. As FIG. 6C illustrates, a vertical streak 151, where developer is not carried on the developing sleeve 142, occurs. The developer is not supplied to the part facing the vertical streak 151 in the front surface of the photosensitive drum 11 because there is no developer in the vertical streak 151. Therefore, a vertical streak 152 is such that a straight line continues on the front surface of the photosensitive drum 11. As FIG. 5A illustrates, the unit that should be replaced to fix such a developing coat defect streak is the developing unit 14.

The characteristics of a white streak which occurs upon a developing coat defect are described using FIG. 5A. First, a streak does not occur in a white background part W in which an image pattern is not formed. Also, a color for which a streak occurs is only the color of the developing unit for which the developing coat defect occurred.

Figure 7A:
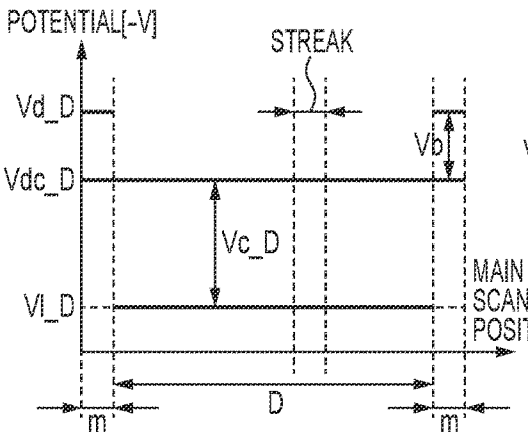
FIGS. 7A to 7F are views describing relations among streaks, charging potential and developing potential.
Figure 7C:
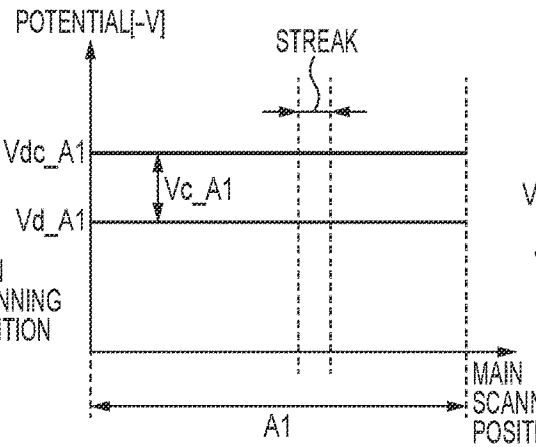
Figure 7E:
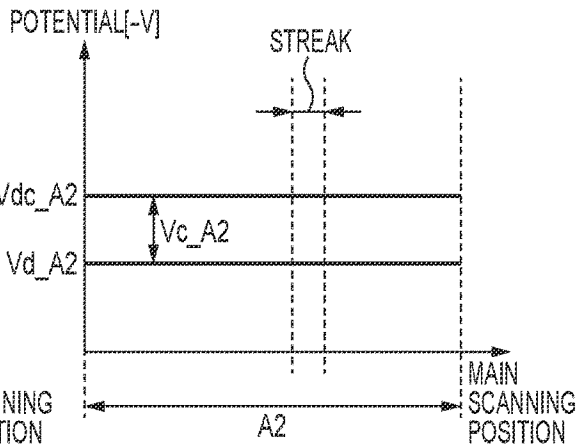
Figure 7B:
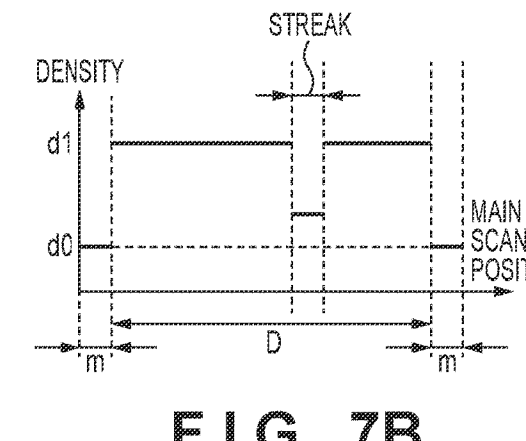
Figure 7D:
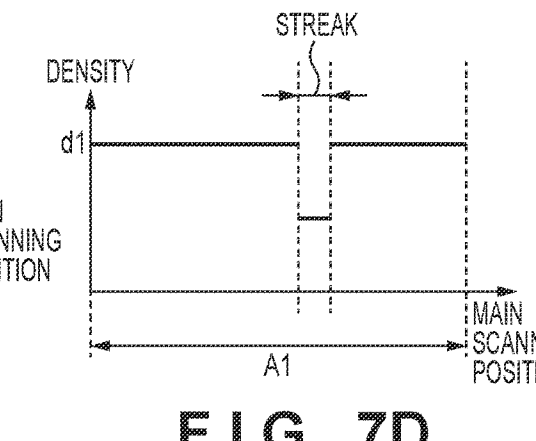
Figure 7F:
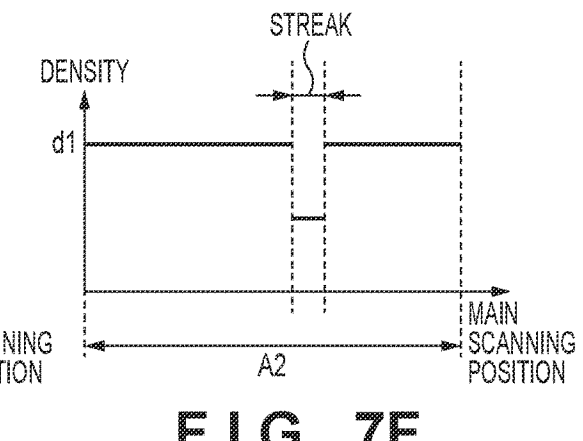

FIG. 7A illustrates a potential at each main scanning position on the photosensitive drum 11 when forming the digital pattern D. FIG. 7B illustrates an optical density at each main scanning position of the sheet P when forming the digital pattern D. FIG. 7C illustrates a potential at each main scanning position on the photosensitive drum 11 when forming the analog pattern A1. FIG. 7D illustrates an optical density at each main scanning position of the sheet P when forming the analog pattern A1. FIG. 7E illustrates a potential at each main scanning position on the photosensitive drum 11 when forming the analog pattern A2. FIG. 7F illustrates an optical density at each main scanning position of the sheet P when forming the analog pattern A2. As these illustrate, a developing coat defect streak is due to developer not being supplied on the developing sleeve 142. Accordingly, a vertical streak occurs in all of the digital pattern D, the analog pattern A1, and the analog pattern A2. Furthermore, there is no difference between the density of a streak that occurs in the analog pattern A1 and the density of a streak that occurs in the analog pattern A2.

Streak Caused by an Exposure Defect

Figure 8A:
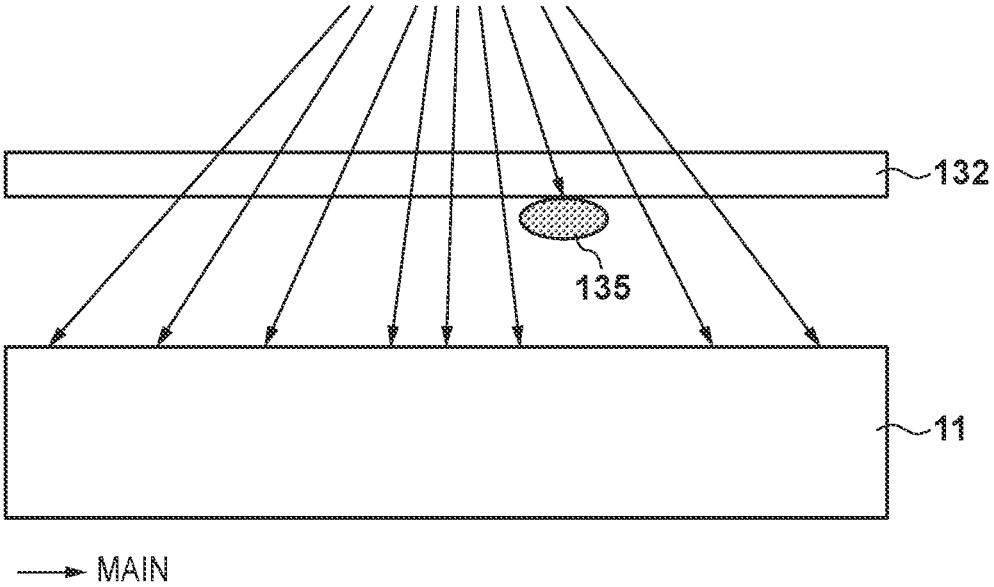
FIGS. 8A and 8B are views describing an exposure defect and a plasticity deformation.

Next, a white streak caused by an exposure defect illustrated in FIG. 5A is described. FIG. 8A is a view for describing a mechanism by which a white streak caused by an exposure defect occurs. A dustproof glass 132 is arranged in a light path along which a laser beam outputted from the exposure unit 13 passes. When a foreign particle 135 such as a hair or toner adheres to a part of the dustproof glass 132, a laser beam irradiated onto the front surface of the photosensitive drum 11 is blocked. That is, a vertical streak occurs when the potential of the electrostatic latent image of a part at which the laser beam is not irradiated due to the foreign particle 135 on the front surface of the photosensitive drum 11 decreasing. This vertical streak becomes a white streak because it occurs due to the amount of applied toner decreasing. The response method for reducing a white streak caused by an exposure defect is to perform cleaning work on the dustproof glass 132, or to replace the exposure unit 13.

Characteristics of a white streak caused by an exposure defect are described using FIG. 5A. First, a streak does not occur in a white background part W in which an image pattern is not formed. Also, the color for which the streak occurs in the digital pattern D is a color for which the exposure unit 13 in which the exposure defect occurred is responsible.

FIG. 9A illustrates a potential at each main scanning position on the photosensitive drum 11 when forming the digital pattern D. FIG. 9B illustrates an optical density at each main scanning position of the sheet P when forming the digital pattern D. FIG. 9C illustrates a potential at each main scanning position on the photosensitive drum 11 when forming the analog pattern A1. FIG. 9D illustrates an optical density at each main scanning position of the sheet P when forming the analog pattern A1. FIG. 9E illustrates a potential at each main scanning position on the photosensitive drum 11 when forming the analog pattern A2. FIG. 9F illustrates an optical density at each main scanning position of the sheet P when forming the analog pattern A2.

As FIG. 9A and FIG. 9B illustrate, a white streak occurs due to an exposure defect (the amount of exposure light becomes smaller). Accordingly, in the digital pattern D, the white streak occurs due to the surface potential becoming higher than Vl_D in a part of main scanning position of the photosensitive drum 11. Meanwhile, as FIG. 9C to FIG. 9F illustrate, a streak does not occur because the analog patterns A1 and A2 are formed without exposure being applied.

Streak Caused by a Charge Defect

Figure 10A:
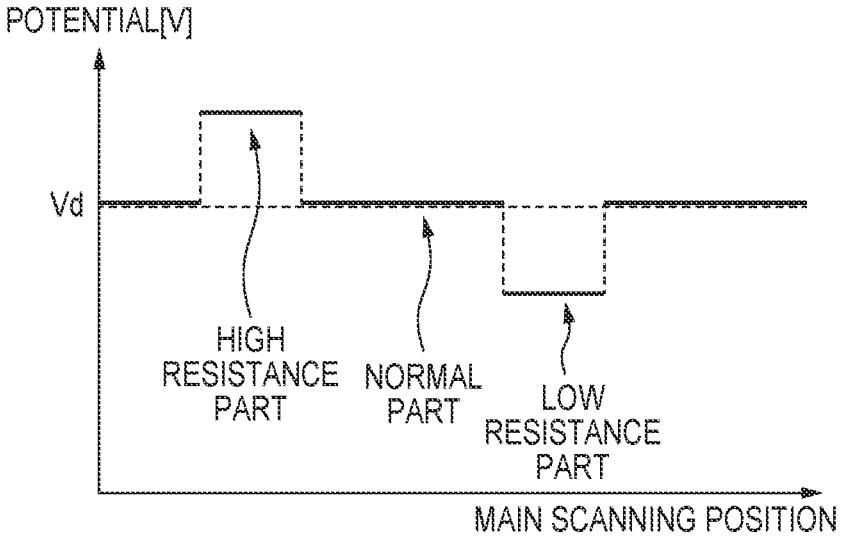
FIGS. 10A and 10B are views describing a relation between a photosensitive drum cleaning defect and a streak.
Figure 10B:
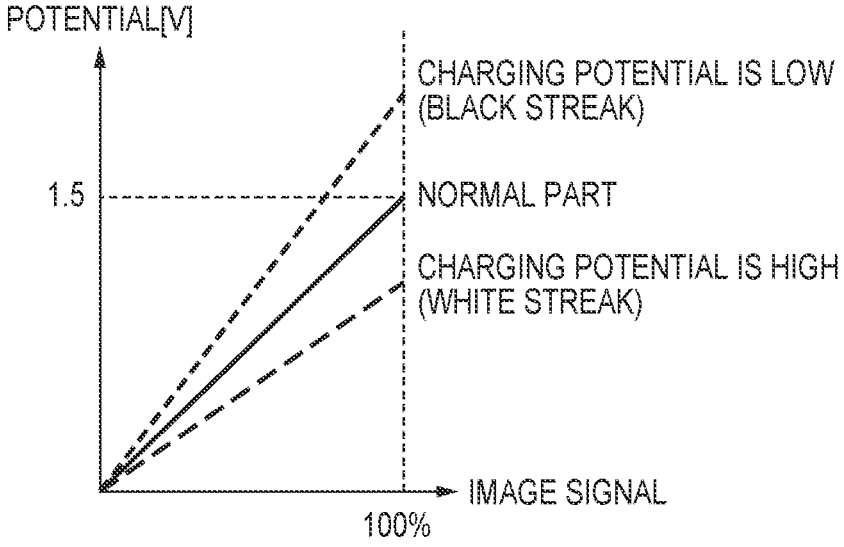

A contact charging scheme in which the photosensitive drum 11 is caused to contact a charging member to perform charging is employed for the charger unit 12 of the present embodiment. In the contact charging scheme, an additive agent such as silicon may adhere to the charging member due to insufficient cleaning at a position in the main scanning direction on the front surface of the photosensitive drum 11. FIG. 10A is a view illustrating a surface potential (charging potential) of the photosensitive drum 11. FIG. 10B is a view illustrating a relation between an image signal and an optical density. As FIG. 10A illustrates, the resistance of a charging member in a main scanning position of a part of the front surface of the photosensitive drum 11 becomes larger, and the charging potential of that position becomes larger. A main scanning region at which the resistance became larger is called a high resistance part. When the charging potential becomes larger, the density of the high resistance part becomes lower than the density of a normal part and a white streak occurs even if each main scanning position of the photosensitive drum 11 is exposed using the same image signal, as FIG. 10B illustrates.

Meanwhile, toner adheres to the charging member when a cleaning defect occurs in the main scanning position in a part of the front surface of the photosensitive drum 11. The resistance of a part at which toner adheres in the front surface of the charging member becomes lower. The resistance of the charging member gradually increases due to endurance, but the resistance of the charging member becomes partially lower even if a surface layer of the charging member is stripped off. The result of this is that the resistance of the charging member becomes partially lower in the main scanning region of a part, and the charging potential becomes lower, as FIG. 10A illustrates. This part is called a low resistance part. When the charging potential becomes lower, the density of the low resistance part becomes higher than the density of a normal part and a black streak occurs even if each main scanning position of the photosensitive drum 11 is exposed using the same image signal as FIG. 10B illustrates.

Characteristics of a charge defect streak are described using FIG. 5A. First, a streak does not occur in a white background part W in which an image pattern is not formed. Also, the color for which the streak occurs in YMCK is a color for which the charger unit 12 in which the charge defect occurred is responsible.

FIG. 11A illustrates a potential at each main scanning position on the photosensitive drum 11 when forming the digital pattern D. FIG. 11B illustrates an optical density at each main scanning position of the sheet P when forming the digital pattern D. FIG. 11C illustrates a potential at each main scanning position on the photosensitive drum 11 when forming the analog pattern A1. FIG. 11D illustrates an optical density at each main scanning position of the sheet P when forming the analog pattern A1. FIG. 11E illustrates a potential at each main scanning position on the photosensitive drum 11 when forming the analog pattern A2. FIG. 11F illustrates an optical density at each main scanning position of the sheet P when forming the analog pattern A2.

As FIG. 11A and FIG. 11B illustrate, the charging potential in the main scanning position of a part of the photosensitive drum 11 that is exposed is different to Vl_D in the digital pattern D. A black streak occurs at a position where the charging potential is lower than Vl_D, and a white streak occurs at a position where the charging potential is higher than Vl_D. As FIG. 11C and FIG. 11D illustrate, a black streak and a white streak occur because the charging potential at parts of the main scanning direction are different to Vd_A1 in the analog pattern A1. Because the charge defect occurs due to a charging member resistance difference, the charge defect is reduced by causing the charging potential of the charger unit 12 to decrease. As FIG. 11E and FIG. 11F illustrate, compared to the analog pattern A1, the effect of the charge defect becomes smaller in the analog pattern A2. That is, the streak improves. The streak improving means that the difference between the optical density of the streak and the optical density of a normal part in the periphery thereof decreases. That is, when a streak improves, it becomes more difficult to notice the streak visually.

Streak Caused by a Plasticity Deformation of the Intermediate Transfer Belt

Figure 8B:
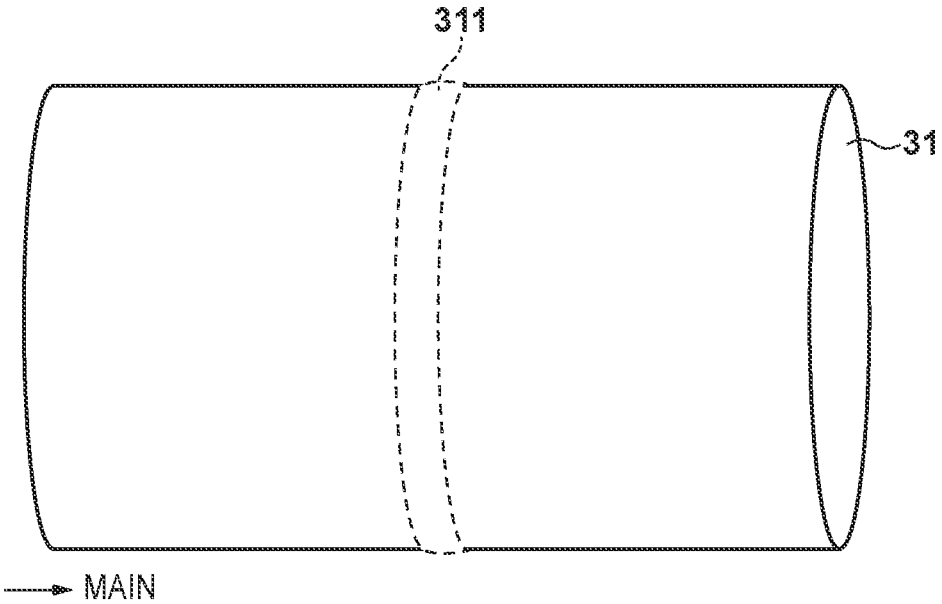

Next, a streak caused by a plasticity deformation of the intermediate transfer belt 31 illustrated in FIG. 5A is described. An inner surface of the intermediate transfer belt 31 that is used for a long period may be scraped, producing a powder. There are cases in which some of the parts that configure the transfer unit adhere to the front surface of the rollers 36 and 37. As FIG. 8B illustrates, a plasticity deformation into a convex shape may occur in a part of the intermediate transfer belt 31. Such a part is called a convex part 311. In this way, when the convex part 311 is produced in the intermediate transfer belt 31, the photosensitive drum 11 and the sheet P tends not to be in contact at the two sides of the convex part 311. Accordingly, the secondary transfer of the toner image to the sheet P is adversely influenced at the two sides, and a white streak occurs. A black streak occurs at the convex part 311 because a lot of toner is secondary transferred to the sheet P. Accordingly, the part that should be replaced to fix the streak due to a plasticity deformation of the intermediate transfer belt 31 is the intermediate transfer unit. Note that a white streak is not a streak of a white color, but rather is a streak where the density is low (there is less toner). Also, a black streak is a streak where the density is high (there is more toner).

Characteristics of a streak caused by a plasticity deformation are described using FIG. 5A. First, a streak does not occur in a white background part W in which an image pattern is not formed. The colors in YMCK for which the streak occurs are all colors. This is because a streak of this type occurs in a secondary transfer unit. Also, because it is independent of the existence or absence of an exposure and the charging potential, the streak occurs in the analog patterns A1 and A2 and not just the digital pattern D.

Streak Caused by a Photosensitive Drum Cleaning Defect

A streak caused by a defect in cleaning of the photosensitive drum 11 is a black streak. There are cases in which a part of a member (blade) that abuts the photosensitive drum 11 in the drum cleaner 15 is defective. This defective part cannot scrape off toner remaining on the photosensitive drum 11 after the primary transfer. This becomes the cause of a black streak. A black streak of this type occurs in the color for which the drum cleaner 15 in which the cleaning defect occurred is responsible. For example, if a cleaning defect occurs in the drum cleaner 15 of the yellow station, a yellow streak occurs. Also, a black streak that accompanies a cleaning defect occurs as a substantially straight line streak in the white background part W. Therefore, the part that should be replaced to reduce a streak accompanying a cleaning defect of the photosensitive drum 11 is the process cartridge 50. In this way, an assembly unit including the drum cleaner 15 is a replacement part.

Characteristics of a streak caused by a cleaning defect are described using FIG. 5A. Because a streak caused by a cleaning defect occurs, the streak occurs in the white background part W in which the image pattern is not formed. The color of the streak that occurs in the white background part W is the same color as the color of the toner accumulated on the drum cleaner 15. Thus the type of the streak is a monochrome streak. Because the streak occurs even for a color for which an image is not formed, it occurs in patterns of all of the colors of yellow, magenta, cyan, and black. For example, a streak occurs in all color patterns because when the drum cleaner 15 responsible for yellow is defective, a yellow streak occurs across the entirety of the sheet P in the sub scanning direction. Also, because it is independent of the existence or absence of an exposure and the charging potential, the streak occurs in all of the digital pattern D and the analog patterns A1 and A2.

Streak Caused by an Intermediate Transfer Belt Cleaning Defect

A black streak that occurs due to a cleaning defect of the intermediate transfer belt 31 is described using FIG. 5A. When a part of a member (a blade or the like) that abuts the intermediate transfer belt 31 in the transfer cleaner 35 is defective, a black streak occurs. This occurs because toner remaining on the intermediate transfer belt 31 after the secondary transfer cannot be scraped off. The color of a streak of this type is a color in which yellow, magenta, cyan, and black toner is mixed (a mixed color). Thus, the unit that should be replaced to reduce a black streak that occurs due to a defect in cleaning the intermediate transfer belt 31 is the transfer cleaner 35.

Characteristics of a streak that occurs due to a cleaning defect of the intermediate transfer belt 31 are described using FIG. 5A. Because a cleaning defect is the cause, the streak occurs in the white background part W in which the image pattern is not formed. Also, because the streak occurs in the white background part W is due to toner accumulated on the transfer cleaner 35, the color of the streak is a color in which yellow, magenta, cyan, and black are mixed. Also, because it is independent of the existence or absence of exposure and charging potential, the streak occurs in all of the digital pattern D and the analog patterns A1 and A2.

[Replacement Part Identification Process]

Figure 12:
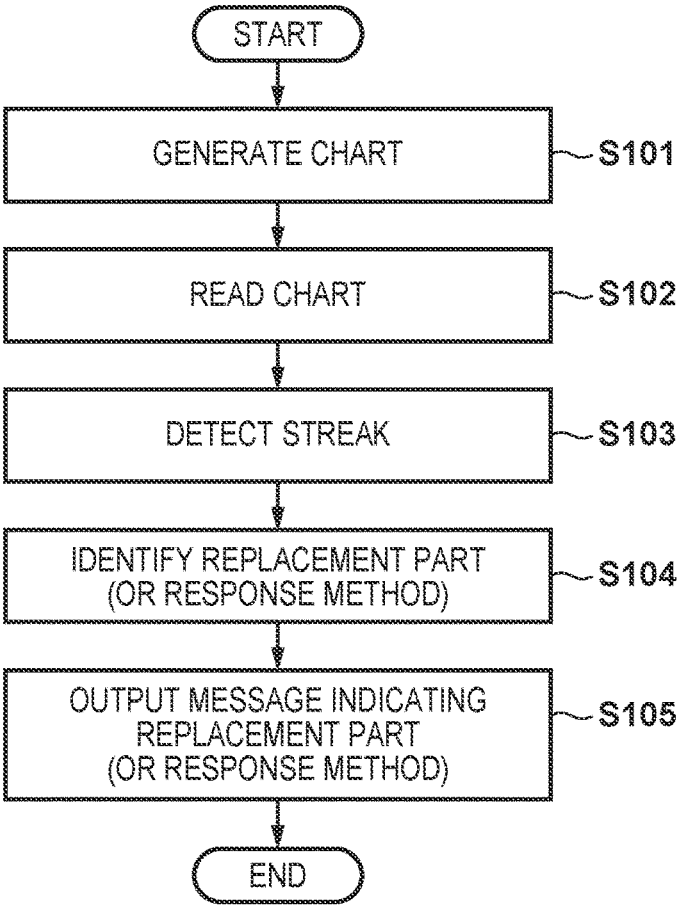
FIG. 12 is a flowchart for illustrating processing for generating a chart and processing for identifying a replacement part.

A process for generating the chart 70 for identifying a replacement part, and a process for identifying a replacement part are described using FIG. 12. The CPU 60 executes the following processing when an instruction to identify a replacement part or an instruction to generate the chart 70 is inputted from the input apparatus 62.

In step S101, the CPU 60 (the chart generation unit 64) generates the chart 70 by forming the white background part W, the digital pattern D and the analog patterns A1 and A2 on the sheet P by controlling the printer 3. The chart generation unit 64 sets a predetermined charging potential to the charger unit 12 to form the white background part W, sets a predetermined developing potential to the developing unit 14, and prohibits the exposure unit 13 from emitting light. By this, the white background part W is formed on the sheet P (the chart 70). Furthermore, the chart generation unit 64 sets a charging potential Vd_D to the charger unit 12 of the yellow station to form a digital pattern DY. Also, the chart generation unit 64 sets a developing potential Vdc_D to the developing unit 14 of the yellow station. Furthermore, the chart generation unit 64 outputs an image signal for forming the digital pattern DY to the exposure unit 13 of the yellow station. By this, the digital pattern DY is formed. Similarly, the digital patterns DM, DC, and DBk are formed. Next, the CPU 60 sets the charging potential Vd_A1 to the charger unit 12 of each color station to form an analog pattern A1Y. Also, the chart generation unit 64 sets a developing potential Vdc_A1 to the developing unit 14 of each color station. By this the analog patterns A1Y, A1M, A1C, and A1Bk are formed. Next, the CPU 60 sets the charging potential Vd_A2 to the charger unit 12 of each color station to form an analog pattern A2Y. Also, the chart generation unit 64 sets a developing potential Vdc_A2 to the developing unit 14 of each color station. By this, the analog patterns A2Y, A2M, A2C, and A2Bk are formed. By the above, the chart 70 is formed, and discharged to a discharge tray of the image forming apparatus 1. Note that the following processing is omitted if a user or a serviceman identifies the replacement part by visually observing the chart 70.

In step S102, the CPU 60 (the diagnostic unit 67) reads the chart 70 by controlling the image reader 2. The diagnostic unit 67 may display to the display apparatus 61 guidance prompting for the chart 70 to be placed on the platen glass 22, and a read start button to be pressed. The result of reading of the chart 70 is stored in the storage apparatus 63.

In step S103, the CPU 60 (the diagnostic unit 67) attempts to detect a streak from the result of reading the chart 70. For example, the diagnostic unit 67 may analyze the image data which is the read result, and obtain a feature amount to detect the streak. An RGB luminance value is included in the read result, and the diagnostic unit 67 divides the read result into an R image, a G image, and a B image, and executes an analysis for each color individually. That is, the diagnostic unit 67 attempts to detect a vertical streak for the image data of each of the R image, the G image, and the B image. Note that the diagnostic unit 67 may attempt to detect a vertical streak for each color after converting the R image, the G image, and the B image into a Y image, an M image, a C image, and a K image. The diagnostic unit 67 calculates an average value of luminance values of a plurality of pixels arranged in a vertical direction of the image data (a conveyance direction of the chart 70 and a scan direction of the image reader 2). This is because electrical noise added by the image reader 2 is reduced thereby. Because in the present embodiment, the width (the length in the sub scanning direction) of the pattern of each color is 30 mm, averaging is applied to the plurality of pixels corresponding to 30 mm. The diagnostic unit 67 performs tilt correction processing to correct a tilt of luminance values (an average value in the vertical direction) in a horizontal direction of the image data (a direction orthogonal to the vertical direction, the main scanning direction). The effect of density non-uniformity of the image pattern and the image reader 2 is reduced by this. The diagnostic unit 67 detects a pixel group (region) in which there is a difference in luminance values in relation to a uniform part (a normal part) in the image data. For example, the diagnostic unit 67 calculates a difference (luminance difference) between an average luminance value in the entirety of the image pattern and the luminance value of each main scanning position (the tilt-corrected luminance value). The diagnostic unit 67 detects a pixel group for which a luminance difference exceeds a predetermined threshold (example: 20% of the average value) as a vertical streak. The diagnostic unit 67 may distinguish a streak whose luminance is lower (density is high) than the luminance of a normal part as a black streak, and conversely may distinguish a streak whose luminance is high (density is low) as a white streak. The diagnostic unit 67 stores in the storage apparatus 63, as a feature amount of the streak, a main scanning position and a sub scanning position at which the streak was detected, a color or a luminance difference of the streak, or the like. Note that the position of the streak indicates where the streak occurred in the white background part W, the digital pattern D, and the analog patterns A1 and A2. The color of the streak is useful in identifying the replacement part. The luminance difference for the streak in the analog pattern A1 and the luminance difference for the streak in the analog pattern A2 are useful in determining whether or not the streak improved.

In step S104, the CPU 60 (the diagnostic unit 67) identifies the replacement part that is the cause of the streak (or the response method) based on the result of reading the chart 70 (streak detection result). For example, the diagnostic unit 67 distinguishes the existence or absence of a streak and the color of the streak (monochrome (YMCK)/mixed color or the like) for each YMCK pattern and the white background part W based on the feature amounts of the streak stored in the storage apparatus 63. The diagnostic unit 67 identifies the cause and the replacement part by comparing the result of distinguishing with an identification condition for identifying the cause and replacement part. In step S105, the CPU 60 (the diagnostic unit 67) displays a message indicating the replacement part and the response method on the display apparatus 61, and transmits it to the PC 124 or the server 128 via the communication IF 55.

Figure 13:
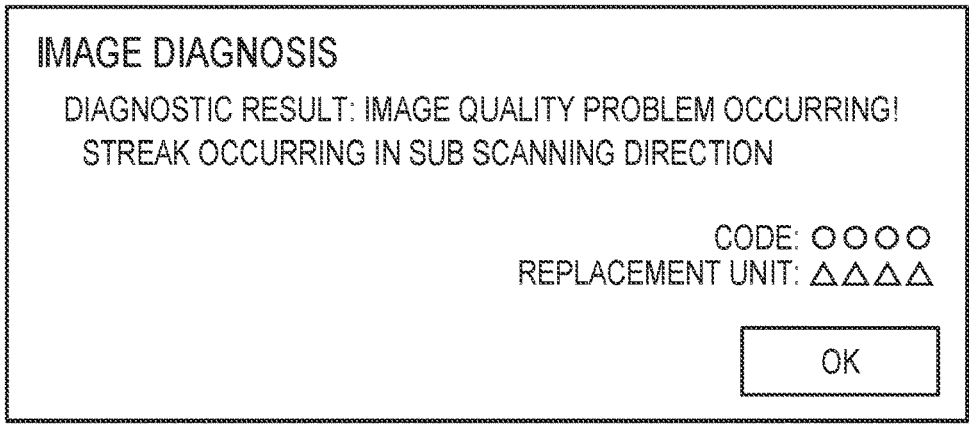
FIG. 13 is a view describing an example of a message for illustrating a replacement part.

FIG. 13 illustrates an example of a message indicating the replacement part and the response method. In this example, that a vertical streak (a streak extending in the sub scanning direction) occurs in the chart 70 and information such as a code indicating the cause and the name of the replacement part is included. The user or the serviceman can easily understand what the cause of the streak is and what the replacement part is by referring to the message. Note that if a vertical streak is not detected, the diagnostic unit 67 displays a message indicating that the image forming apparatus 1 is normal on the display apparatus 61. In this way, a user, a serviceman or the like can easily understand what the replacement part is because they can know that a vertical streak occurred and what the replacement part is by the specific information.

[Details of Replacement Part Identification Process]

Figure 14:
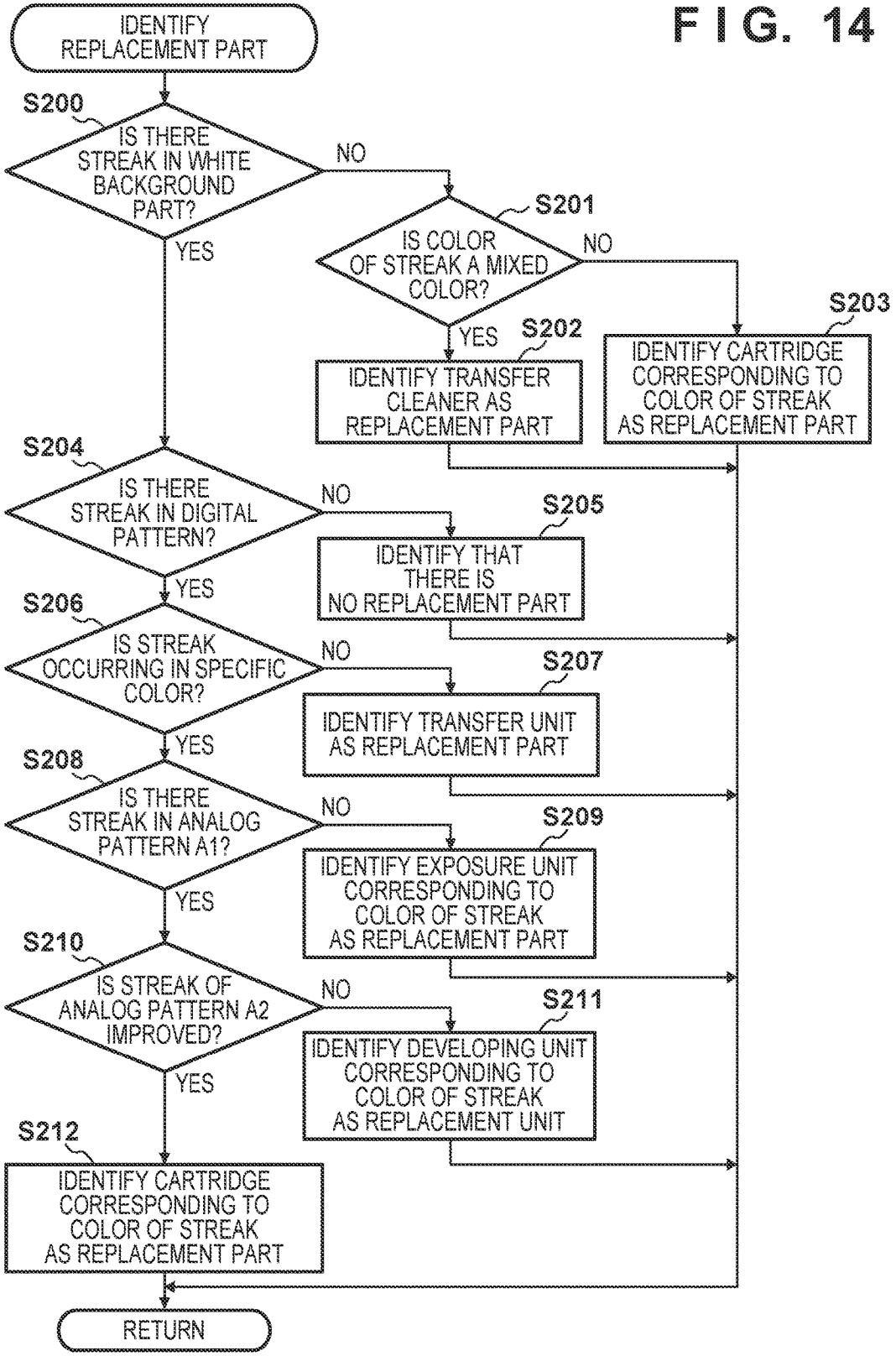
FIG. 14 is a flowchart for illustrating processing for identifying a replacement part.

FIG. 14 is a flowchart illustrating details of processing for identifying a replacement part and a response method. The CPU 60 (the diagnostic unit 67) attempts to detect a vertical streak at each main scanning position (example: every 1 mm). Accordingly, a vertical streak may be detected at a plurality of main scanning positions. Also, the causes of the plurality of vertical streaks may differ. Accordingly, the CPU 60 (the diagnostic unit 67) identifies the cause and the replacement part for each streak. Note that the replacement part may be identified by identifying the cause of the occurrence of the streak. Each determination process illustrated in FIG. 14 may be an accumulation of identification conditions for identifying the replacement part and the cause.

In step S200, the CPU 60 reads a feature amount from the storage apparatus 63, and determines whether or not there is a streak in the white background part W. The coordinates of the white background part W in the chart 70 are known. The CPU 60, by comparing the coordinates of the white background part W and the position of the streak, distinguishes the existence or absence of a streak in the white background part W. If there is a streak in the white background part W, the CPU 60 advances to step S201.

In step S201, the CPU 60 determines whether or not the color of the streak is a mixed color. If the color of the streak is a mixed color, the CPU 60 advances to step S202.

In step S202, the CPU 60 distinguishes that the cause of the streak is a defect in cleaning the intermediate transfer belt 31, and identifies the transfer cleaner 35 as the replacement part. Meanwhile, if the color of the streak is a single YMCK color, the CPU 60 advances to step S203.

In step S203, the CPU 60 distinguishes the cause of the streak to be a cleaning defect of the photosensitive drum 11, and identifies the process cartridge 50 corresponding to the color of the streak as the replacement part. In step S200, if no streak is detected in the white background part W, the CPU 60 advances to step S204.

In step S204, the CPU 60 reads a feature amount from the storage apparatus 63, and determines whether or not there is a streak in the digital patterns DY to the DBk. The coordinates of the digital patterns DY to DBk in the chart 70 are known. The CPU 60 distinguishes the existence or absence of a streak in the digital patterns DY to DBk by comparing the position of the streak and the coordinates of the digital patterns DY to DBk. If there is no streak in any of the digital patterns DY to DBk, the CPU 60 advances to step S205.

In step S205, the CPU 60 identifies that there is no replacement part (normal). Meanwhile, the CPU 60 advances to step S206 when it detects a streak in any of the digital patterns DY to DBk.

In step S206, the CPU 60 reads feature amounts from the storage apparatus 63, and determines whether or not a streak occurs in a particular color. This is the same as determining whether or not a streak is occurring in all colors (all of the digital patterns DY to DBk). If a streak is occurring for all colors, the CPU 60 advances to step S207.

In step S207, the CPU 60 distinguishes the cause of the streak as a plasticity deformation of the intermediate transfer belt 31, and identifies the transfer unit included in the intermediate transfer belt 31 as the replacement part. Meanwhile, if a streak is occurring for a particular color, the CPU 60 advances to step S208.

In step S208, the CPU 60 determines whether or not a streak is occurring in the analog pattern A1 of the same color as the color of the digital pattern D in which the streak is occurring. If there is no streak in the analog pattern A1, the CPU 60 advances to step S209.

In step S209, the CPU 60 distinguishes that the cause of the streak is an exposure defect, and identifies the exposure unit 13 corresponding to the color of the streak as the replacement part. Note that the CPU 60 may identify cleaning of the exposure unit 13 corresponding to the color of the streak as the response method. If a streak is occurring in the analog pattern A1 of the same color as the color of the digital pattern D in which the streak is occurring, the CPU 60 advances to step S210.

In step S210, the CPU 60 determines whether or not the streak of the analog pattern A2 is improved in relation to the streak of the analog pattern A1. Note that the analog pattern A1 and the analog pattern A2 are of the same color. For example, the CPU 60 may read feature amounts from the storage apparatus 63, and compare the luminance difference (density difference) of the streak of the analog pattern A1 and the luminance difference (density difference) of the streak of the analog pattern A2. If the density difference of the streak of the analog pattern A2 is smaller than the density difference of the streak of the analog pattern A1, the streak improved, and therefore the CPU 60 advances to step S212.

In step S212, the CPU 60 distinguishes the cause of a streak to be a charge defect, and identifies the process cartridge 50 corresponding to the color of the streak as the replacement part. Meanwhile, if the streak of the analog pattern A2 has not improved compared to the streak of the analog pattern A1, the CPU 60 advances to step S211.

In step S211, the CPU 60 distinguishes that the cause of the streak is a developing coat defect, and identifies the developing unit 14 corresponding to the color of the streak as the replacement part.

In this way, the CPU 60 generates the chart 70, and identifies the cause of the streak and the replacement part by analyzing the streak that occurs in the chart 70. Also, the CPU 60 may output a message indicating the cause of the streak and the replacement part to the display apparatus 61 or the like. By this, it becomes possible for a user or a serviceman to easily recognize the cause of the streak and the replacement part. Thereby, the work time (downtime) necessary for maintenance may be significantly shortened. Also, because a part involved in the streak is identified, it may be that the replacement of a part that is not involved in the streak may be avoided. Thereby, maintenance costs may also be reduced as well as maintenance time. The message indicating the cause of the streak and the replacement part may be transmitted to the server 128 of the serviceman via the network. Because the serviceman can know what the replacement part is in advance, he can reliably bring the replacement part to perform the maintenance. Processing for identification of the cause of the streak, the replacement part, or the like illustrated in FIG. 14 may be executed by the user or the serviceman visually observing the chart 70. Here, a color printer is employed as an example, but the present embodiment may be applied to a monochrome printer.

The chart 70 illustrated in FIG. 3 is merely an example. The order of the white background part W, the digital pattern D, and the analog patterns A1 and A2 in the chart 70 may be another order. In essence, it is sufficient that the white background part W, the digital pattern D, and the analog patterns A1 and A2 be included in the chart 70. In particular, it is sufficient that the analog patterns A1 and A2 be included in the chart 70 to identify whether the cause of the streak is in the charger unit 12 or in the developing unit 14.

Examples of an image error other than a vertical streak are a horizontal streak that occurs in accordance with a rotation period of the rotation unit in a direction orthogonal to the conveyance direction of the sheet P, and an image scratch that occurs when there is a scratch in a rotation unit. It is possible to make the length in the conveyance direction of the chart 70 greater than or equal to the length of the rotation unit that is the cause of a horizontal streak or an image scratch, and to detect a horizontal streak, an image scratch, or the like. An identification condition that associates a characteristic of a horizontal streak or an image scratch and a part corresponding to that characteristic may be stored in the storage apparatus 63. In such a case, the CPU 60 identifies a replacement part by comparing a characteristic of a detected horizontal streak or image scratch with the identification condition.

In the first embodiment, by generating the chart 70 which includes a plurality of analog patterns A1 and A2 for which the optical density is the same but the charging potential is different, it is identified whether the cause of a streak is in the charger unit 12 or in the developing unit 14. However, it is difficult to detect a slight charge defect simply by causing the charging potential to differ. This is because the difference between a streak of the analog pattern A1 and a streak of the analog pattern A2 is not sufficiently large with a slight charge defect. Accordingly, in the second embodiment, while the image forming apparatus 1 forms the analog pattern A1 by performing processing for charging by the charger unit 12, it forms the analog pattern A2 without performing processing for charging by the charger unit 12. By this, the analog pattern A2 becomes an image pattern on which there is no effect due to a charge defect. Accordingly, it becomes possible to detect a slight charge defect by comparing the analog pattern A1 that is formed by charge processing being applied and the analog pattern A2 that is formed without charge processing being applied. That is, it becomes possible to distinguish whether the cause of the streak is a charge defect or a developing coat defect. Note that other than the method for forming the analog pattern A2 and the processing for identifying the replacement part, the second embodiment is the same as the first embodiment. Accordingly, parts that are described previously are omitted.

[Method for Forming the Analog Pattern A2]

Figure 15:
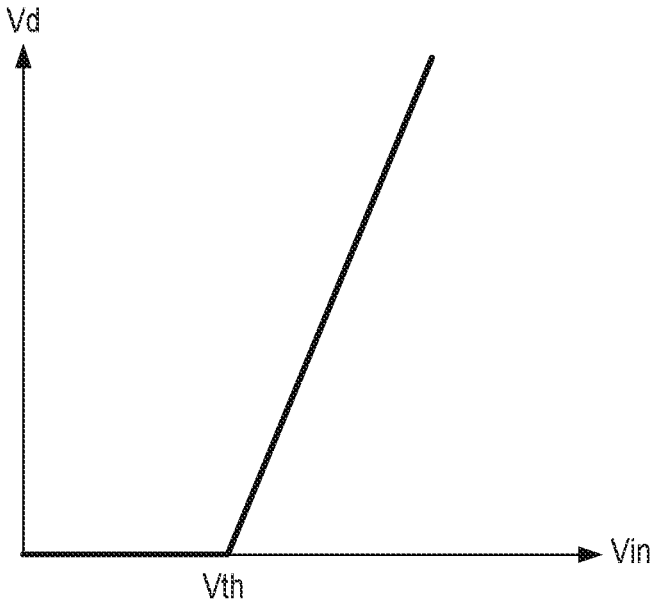
FIG. 15 is a view describing relations between a charge voltage of a charger unit and a charging potential of a photosensitive drum.

The method of forming an image without performing processing for charging by the charger unit 12 is described using FIG. 15. FIG. 15 indicates a relationship between an applied voltage Vin and a charging potential Vd of the photosensitive drum 11 in the contact charging scheme. When the charge control unit 65 sets an applied voltage Vin which is applied to the charging member of the charger unit 12 to be less than or equal to a discharge start voltage Vth, the charging potential Vd of the photosensitive drum 11 is approximately 0[V]. In this way, in the second embodiment, the charging potential of the photosensitive drum 11 is controlled to be approximately 0[V] by setting the applied voltage Vin to a voltage (example: 0[V]) less than or equal to the discharge start voltage Vth (example: 400[V]).

The charge of the front surface of the photosensitive drum 11 may be removed in order to further reduce the effect of the charger unit 12 on the analog pattern A2. For example, a light irradiation for destaticization from a pre-exposure light source in relation to the front surface of the photosensitive drum 11 which is cleaned by the drum cleaner 15 may be performed. Configuration may be taken such that processing for charging the photosensitive drum 11 ceases to be applied by controlling the charging power supply 68 so that the charge control unit 65 does not distribute current to the metal wire in a case where a non-contact charging scheme is used.

[Replacement Part Identification Process]

FIG. 5B is for describing a relation between a type of vertical streak detected in the image forming apparatus 1 and the existence or absence of a streak in each pattern. In FIG. 5B, the point that differs from FIG. 5A is that there is no occurrence of a streak caused by the charge defect in the analog pattern A2 that is formed without charge processing being applied.

The CPU 60 generates the chart 70 in accordance with the flowchart illustrated in FIG. 12, but no charge processing is applied when the analog pattern A2 is generated in the second embodiment. Other processing in the second embodiment is the same as in the first embodiment. For example, control is performed so that the difference between the charging potential and the developing potential when generating the analog pattern A2 and the difference between the charging potential and the developing potential when generating the analog pattern A1 becomes the same. By this, the optical density of the analog pattern A1 and the optical density of the analog pattern A2 become the same.

Figure 16:
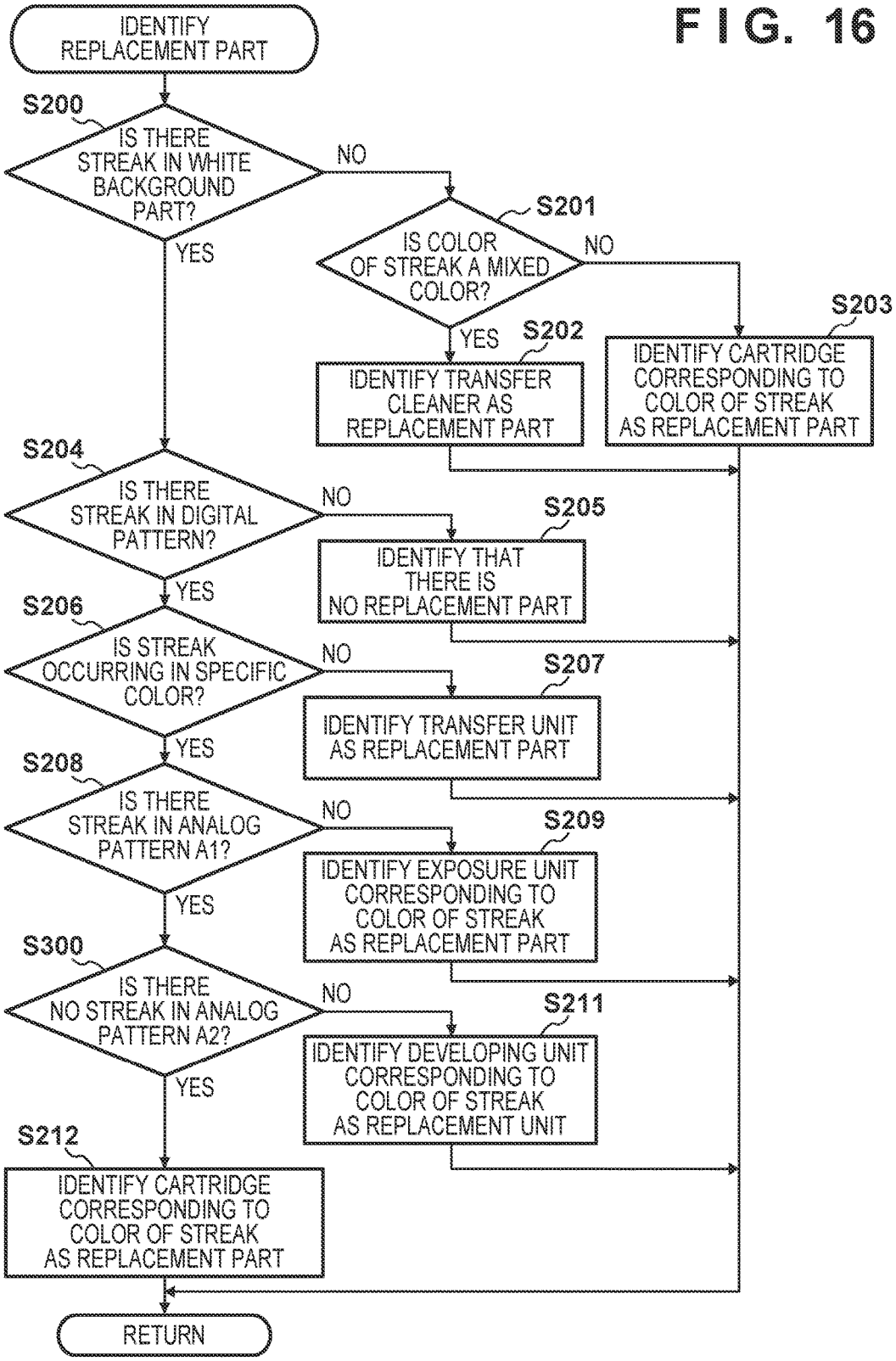
FIG. 16 is a flowchart for illustrating processing for identifying a replacement part.

FIG. 16 is a flowchart illustrating details of processing for identifying a replacement part and a response method. In FIG. 16, what is different from FIG. 14 is that step S210 is replaced with step S300.

In step S300, the CPU 60 reads a feature amount from the storage apparatus 63, and determines whether there is no streak in the analog pattern A2. If there is a streak in the analog pattern A2, the CPU 60 advances to step S211. If there is no streak in the analog pattern A2, the CPU 60 advances to step S212. That is, if there is no streak in the analog pattern A2, the CPU 60 identifies a charge defect as the cause of the streak, and identifies the process cartridge 50 including the charger unit 12 as the replacement part. Also, the replacement part is a replacement part corresponding to the color of the streak. For example, if there is no streak in the yellow analog pattern A2 even though there is a streak in the yellow analog pattern A1, the process cartridge 50 responsible for yellow is identified as the replacement part.

In this way, in the second embodiment, the chart 70 including the analog pattern A1 formed by charge processing being applied and the analog pattern A2 formed without charge processing being applied is generated. By this, it is possible to distinguish a streak caused by a slight charge defect and a streak caused by the developing unit 14. In this way, in the second embodiment, it becomes possible to distinguish reliably even if there is a slight charge defect that is difficult to distinguish by the first embodiment. That is, it is possible to identify with good precision whether the cause of the streak is in the charger unit 12 or in the developing unit 14.

CONCLUSION

As described above, the photosensitive drum 11 functions as an image carrier. The charger unit 12 functions as a charging unit that causes the front surface of the photosensitive drum 11 to be charged to a predetermined potential. The exposure unit 13 functions as an exposure unit that forms an electrostatic latent image by irradiating light on the photosensitive drum 11. The developing unit 14 functions as a developer unit that forms a toner image by developing by causing toner to adhere to the electrostatic latent image formed by the photosensitive drum 11. The primary transfer unit 17, the secondary transfer unit 27 and the like function as a transfer unit that transfers a toner image to the sheet P. The fixing device 40 functions as a fixing unit that causes a toner image transferred to the sheet P to be fixed to the sheet. The CPU 60 functions as a control unit that controls the charger unit 12 and the developing unit 14 so as to form a test image for identifying a replacement part on the sheet P. The pattern formed on the sheet P or the chart 70 is an example of a test image. Note that the sheet P to which a test image is formed is referred to as the chart 70, but the test image itself may be understood to be the chart 70. The analog pattern A1 is an example of a first non-exposure image which is a toner image formed with a first charging potential (example: Vd_A1) being applied and without exposure being applied. The analog pattern A2 is an example of a second non-exposure image which is a toner image formed with a second charging potential different to the first charging potential (example: Vd_A2) being applied and without exposure being applied. It becomes possible to easily distinguish which of the charger unit 12 and the developing unit 14 to replace by using the two analog patterns having different charging potentials in this way. That is, by the present embodiment, the image forming apparatus 1 which forms a test image by which it is possible to identify which of a charging unit and a developer unit should be replaced is provided. Note that the user and the serviceman may identify the replacement part by visual observation using the chart 70, and the image forming apparatus 1 may identify the replacement part by reading the chart 70.

As described using FIG. 1, the intermediate transfer belt 31 functions as an intermediate transfer body to which a toner image is primary transferred. The primary transfer unit 17 functions as a primary transfer unit that primary transfers a toner image to the intermediate transfer belt 31. The drum cleaner 15 functions as a first cleaning unit that cleans the photosensitive drum 11. The secondary transfer unit 27 functions as a secondary transfer unit that secondary transfers a toner image primary transferred to the intermediate transfer belt 31 to the sheet P. The transfer cleaner 35 functions as a second cleaning unit that cleans the intermediate transfer belt 31. This kind of intermediate transfer system may be employed, and a direct transfer method in which the toner image is directly transferred to the sheet P from the photosensitive drum 11 may be employed.

As described using FIG. 4, the CPU 60 may set the developing potential of the developing unit 14 so that the difference (example: Vc_A1) between the first charging potential and the developing potential of the developing unit 14 (example: Vdc_A1) and the difference (example: Vc_A2) between the second charging potential and the developing potential (example: Vdc_A2) of the developing unit 14 becomes the same. By this, since the optical density of the analog pattern A1 and the optical density of the analog pattern A2 become the same, it becomes easier to distinguish a difference in streaks that occur in these patterns.

In the case when the image forming apparatus 1 identifies the replacement part by reading the chart 70, the image reader 2 functions as a reading unit that reads the test image. The CPU 60 (the diagnostic unit 67) functions as an identification unit for identifying a replacement part by comparing a result of reading the chart 70 and an identification condition for identifying the replacement part. An example of identification conditions is illustrated as a flowchart in FIG. 14. The CPU 60, the display apparatus 61, and the communication IF 55 function as an output unit that outputs a message indicating an identified replacement part. By this, the user and the serviceman are able to easily ascertain what the replacement part is, and the time over which image formation cannot be executed is shortened.

As described in relation to step S210, the CPU 60 may identify the charger unit 12 as the replacement part if there is a streak (example: a vertical streak) in the sheet P conveyance direction in the analog pattern A1 and there is a vertical streak that does not stand out as much as the vertical streak present in the analog pattern A1 in the analog pattern A2. Also, as described in relation to step S300, the CPU 60 may identify the charger unit 12 as the replacement part if there is a streak (example: a vertical streak) in the sheet P conveyance direction in the analog pattern A1 and there is no streak in the analog pattern A2. Because a charge defect of the charger unit 12 is the typical cause of such a vertical streak, the occurrence of a vertical streak may be reduced by replacing the charger unit 12.

As described in relation to step S211, the CPU 60 may identify the developing unit 14 as the replacement part if there is a vertical streak in the analog pattern A1 and there is a vertical streak of the same optical density as the streak present in the analog pattern A1 in the analog pattern A2 as well. When a developing coat defect of the developing unit 14 occurs, a vertical streak of an optical density that is independent of the charging potential occurs. Accordingly, it is possible to identify the developing unit 14 as the replacement part with good precision by comparing a streak of the analog pattern A1 and a streak of the analog pattern A2.

The present invention can be applied not only to an image forming apparatus that forms solid color images, but also to an image forming apparatus that forms multicolor images using a plurality of different colors of toner. In the foregoing embodiment, the four colors of YMCK are exemplified, but it is sufficient if two or more colors are used. For example, the photosensitive drum 11 that is responsible for yellow is an example of a first photosensitive member that carries a toner image developed by toner of a first color. The photosensitive drum 11 that is responsible for magenta, cyan, or black is an example of a second photosensitive member that carries a toner image developed by toner of a second color. The charger unit 12 arranged in the yellow station is an example of a first charger unit arranged in relation to the first photosensitive member. The charger unit 12 arranged in the magenta, cyan, or black station is an example of a second charger unit arranged in relation to the second photosensitive member. The developing unit 14 arranged in the yellow station is an example of a first developing unit that forms a toner image using toner of a first color. The developing unit 14 arranged in the magenta, cyan or black station is an example of a second developing unit that forms a toner image using toner of a second color. As illustrated in FIG. 3, the analog pattern A1 and the analog pattern A2 which are formed using only toner of the first color are included in the chart 70. Similarly, the analog pattern A1 and the analog pattern A2 which are formed using only toner of the second color are included in the chart 70. As described in relation to step S211 and step S212, the CPU 60 identifies the first charger unit or the first developing unit as the replacement part when a streak is detected in the analog pattern A1 and the analog pattern A2 that are formed using only toner of the first color. Also, the CPU 60 identifies the second charger unit or the second developing unit as the replacement part when a streak is detected in the analog pattern A1 and the analog pattern A2 that are formed using only toner of the second color. By forming an analog pattern using a monochrome toner in this way, it becomes possible to identify which color the station of the part that should be replaced is responsible for.

The chart 70 may have the digital pattern D. The digital pattern D is an example of an exposure image which is a toner image formed by an exposure by the exposure unit 13 being applied. The digital pattern D may have a plurality of exposure patterns (the digital patterns DY to DBk) formed by monochrome toner of respectively different colors. As described in relation to step S206 and step S207, the CPU 60 may identify the intermediate transfer belt 31 as the replacement part when a streak is detected in each of the plurality of exposure patterns (in other words in all colors). When a plasticity deformation or the like of the intermediate transfer belt 31 occurs, a streak occurs in all colors. It becomes possible to identify the intermediate transfer belt 31 as the replacement part based on this characteristic.

As exemplified in FIG. 3, the chart 70 may further have a white background part W on which no toner image is formed. As explained in relation to step S200, step S201, and step S203, the CPU 60 may identify the drum cleaner 15 as the replacement part when a streak formed using a monochrome toner is detected in the white background part W. When a part of the drum cleaner 15 is defective, a monochrome vertical streak occurs. For example, if a yellow vertical streak occurs in the white background part W, the streak is caused by the drum cleaner 15 that is responsible for yellow. The CPU 60 can identify the drum cleaner 15 as the replacement part based on this characteristic.

As explained in relation to step S201 and step S202, the CPU 60 may identify the transfer cleaner 35 as the replacement part when a streak formed such that toner of a plurality of colors is mixed is detected in the white background part W. When the transfer cleaner 35 reaches the end of its life span, it ceases to be able to sufficiently clean the toner remaining on the intermediate transfer belt 31. The CPU 60 can identify the transfer cleaner 35 as the replacement part based on this characteristic.

As described in relation to step S208 and step S209, if a streak occurs in the digital pattern D and no streak occurs in the analog pattern A1, it may be identified that cleaning of the exposure unit 13 is necessary, and the exposure unit 13 may be identified as the replacement part. As explained using FIG. 8A, light is blocked and a vertical streak occurs when the foreign particle 135 adheres to the exposure unit 13. Accordingly, the streak may be fixed if the exposure unit 13 is replaced or the exposure unit 13 is cleaned. It becomes possible to identify a streak caused by the exposure unit 13 in this way, and it becomes possible for a user or a serviceman to perform maintenance more efficiently.

As described in FIG. 1, the charger unit 12, the photosensitive drum 11, and the drum cleaner 15 may be integrated as a process unit (example: the process cartridge 50). The CPU 60 identifies the process cartridge 50 as the replacement part when it is necessary to replace the charger unit 12 or the drum cleaner 15. By this, it becomes possible for a user or a serviceman to efficiently replace a part. Because the life spans of the charger unit 12, the drum cleaner 15, and the photosensitive drum 11 are designed to be the same, if one of them reaches the end of its life span, the other parts will also soon reach the end of their life spans. Accordingly, by employing a cartridge or an assembly, it becomes possible to efficiently replace a part that has reached the end of its life span and a part that is close to the end of its life span all at once. Also, replacement work becomes easier.

As described in FIG. 1, the intermediate transfer belt 31 and the transfer cleaner 35 may be integrated as a transfer unit (example: transfer unit). The CPU 60 identifies the transfer unit as the replacement part when replacement of the intermediate transfer belt 31 becomes necessary. By this, it becomes possible to efficiently replace a part that reached the end of its life span and a part that is close to the end of its life span all at once.

The display apparatus 61 functions as a display unit that displays a message indicating the replacement part. By this, it becomes possible for a user or a serviceman to easily find out what the replacement part is by reading the message. The communication IF 55 functions as a transmission unit that transmits to the server 128 a message indicating the replacement part. By this, it becomes possible for a serviceman to easily find out what the replacement part is by reading the message via the network, and to prepare the replacement part.

As described above, by making the optical density of the analog pattern A1 and the optical density of the analog pattern A2 become the same, distinguishing of a difference in streaks that occur in these patterns is facilitated. The CPU 60 (the chart generation unit 64 and the developing control unit 66) may adjust the developing potential of the developing unit 14 so that the optical density of the analog pattern A1 and the optical density of the analog pattern A2 become the same value (example: 0.6). Note that detection of a streak may be facilitated by setting these densities to a halftone (an intermediate density).

As described in the second embodiment, the second charging potential may be a potential that is OV or more and less than or equal to a discharge start voltage. By this it becomes possible to identify the charger unit 12 in which a slight charge defect occurs as the replacement part.

A pre-exposure light source that executes a pre-exposure may be arranged between the drum cleaner 15 and the charger unit 12 in a rotation direction of the photosensitive drum 11. The pre-exposure light source functions as a destaticization unit that destaticizes the front surface of the photosensitive drum 11 which is cleaned by the drum cleaner 15. The charger unit 12 causes the front surface of the photosensitive drum 11 which has been destaticized by the pre-exposure light source to be charged. By this, it becomes possible to cause the front surface of the photosensitive drum 11 to be charged uniformly. The result of this may be that it becomes possible to reduce density non-uniformity in the chart 70, and to detect a streak with good precision.

Note that the exposure unit 13 of the yellow station is an example of a first exposure unit that forms an electrostatic latent image by irradiating light onto the first photosensitive member. The primary transfer unit 17 of the yellow station is an example of a first primary transfer unit that primary transfers a toner image formed using toner of a first color to the intermediate transfer belt 31. The exposure unit 13 arranged in the magenta, cyan or black station is an example of a second exposure unit that forms an electrostatic latent image by irradiating light onto the second photosensitive member. The primary transfer unit 17 arranged in the magenta, cyan or black station is an example of a second primary transfer unit that primary transfers a toner image formed using toner of a second color to an intermediate transfer body. As described above, the CPU 60 identifies the replacement part by comparing the result of reading a test image formed by only toner of a first color, a result of reading a test image formed by only toner of a second color, and an identification condition for identifying the replacement part. Here, the identification conditions illustrated in FIG. 14 and FIG. 16 are revisited. The first condition is that a streak of a first color is formed on the white background part W which is formed in the periphery of the test image. When the first condition is satisfied, the CPU 60 identifies the cleaning unit of the first photosensitive member as the replacement part. A second condition is that a streak of a second color is formed on the white background part W which is formed in the periphery of the test image. When the second condition is satisfied, the CPU 60 identifies the cleaning unit of the second photosensitive member as the replacement part. A third condition is that a streak which is a color mixture of the first color and the second color is formed on the white background part W which is formed in the periphery of the test image. When the third condition is satisfied, the CPU 60 identifies the cleaning unit of the intermediate transfer body as the replacement part. The fourth condition is that there is a streak in both an exposure image of the first color and an exposure image of the second color (in other words in all colors). When the fourth condition is satisfied, the CPU 60 identifies the intermediate transfer body as the replacement part. A fifth condition is that there is a streak in an exposure image of the first color, and there is no streak in an exposure image of the second color, and there is no streak in a first non-exposure image of the first color. If the fifth condition is satisfied, the CPU 60 identifies that cleaning of the first exposure unit is necessary. A sixth condition is that there is no streak in an exposure image of the first color, and there is a streak in an exposure image of the second color, and there is no streak in a first non-exposure image of the second color. If the sixth condition is satisfied, the CPU 60 identifies that cleaning of the second exposure unit is necessary. A seventh condition is that there is a streak in the exposure image of the first color, there is no streak in the exposure image of the second color, and the streak occurring in the first non-exposure image of the first color is more remarkable than the streak occurring in the second non-exposure image of the first color. That is, there are cases in which compared to a streak occurring in the first non-exposure image of the first color, a streak occurring in the second non-exposure image of the first color is improved. When the seventh condition is satisfied, the CPU 60 identifies the first charger unit responsible for the first color as the replacement part. An eighth condition is that there is a streak in the exposure image of the first color, there is no streak in the exposure image of the second color, and the density of the streak occurring in the first non-exposure image of the first color is of the same degree as the density of the streak occurring in the second non-exposure image of the first color. When the eighth condition is satisfied, the CPU 60 identifies the first developing unit responsible for the first color as the replacement part. A ninth condition is that there is a streak in the exposure image of the first color, there is a streak in the exposure image of the second color, and the streak occurring in the first non-exposure image of the second color is more remarkable than the streak occurring in the second non-exposure image of the second color. That is, there is cases in which compared to a streak occurring in the first non-exposure image of the second color, a streak occurring in the second non-exposure image of the second color is improved. When the ninth condition is satisfied, the CPU 60 identifies the second charger unit as the replacement part. A tenth condition is that there is no streak in the exposure image of the first color, there is a streak in the exposure image of the second color, and the density of the streak occurring in the first non-exposure image of the second color is of the same degree as the density of the streak occurring in the second non-exposure image of the second color. When the tenth condition is satisfied, the CPU 60 identifies the second developing unit as the replacement part. By employing these kinds of identification conditions, it becomes possible to identify various parts involved in image formation as the replacement part. These identification conditions are stored in the storage apparatus 63 as data or a program, and are referenced by the CPU 60 (the diagnostic unit 67).

Note that the chart 70 is an example of a test chart on which a test image is formed in order to identify a replacement part of the image forming apparatus 1. By providing such a chart 70, a user or a serviceman can easily identify whether the charger unit should be replaced or whether the developing unit should be replaced.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-084761, filed Apr. 20, 2016, which is hereby incorporated by reference herein in its entirety.

What is claimed is:

1. An image forming apparatus, comprising:

a photosensitive member;

a charging unit configured to charge the photosensitive member;

an exposure unit configured to expose the photosensitive member, which is charged by the charging unit, to form an electrostatic latent image;

a developer unit configured to develop the electrostatic latent image on the photosensitive member, using a developer, to form an image;

an intermediate transfer body to which the image on the photosensitive member is transferred;

a transfer unit configured to transfer the image on the intermediate transfer body to a sheet;

a first removing unit configured to remove developer remaining on the photosensitive member;

a second removing unit configured to remove developer remaining on the intermediate transfer body; and a controller configured to output a test sheet on which a test image is formed by controlling the photosensitive member, the charging unit, the exposure unit, the developer unit, and the transfer unit, and to obtain read data related to the test sheet, and to detect a streak image included in the test sheet based on the read data, wherein the read data is outputted from a reading device, the test image includes a first test image, a second test image, and a third test image, the controller, in a case where the first test image is formed, controls the charging unit to adjust a potential of the photosensitive member to a first charging potential, controls the exposure unit to form an electrostatic latent image corresponding to the first test image, and controls the developer unit to adjust a potential of the developer unit to a first developing potential, the controller, in a case where the second test image is formed, controls the charging unit to adjust the potential of the photosensitive member to a second charging potential, but not cause the exposure unit to expose the photosensitive member, and controls the developer unit to adjust the potential of the developer unit to a second developing potential, the controller, in a case where the third test image is formed, controls the developer unit to adjust the potential of the developer unit to a third developing potential, but not cause the charging unit to charge the photosensitive member, and not cause the exposure unit to expose the photosensitive member, the controller controls the second charging potential, the second developing potential, and the third developing potential so that a density of the second test image and a density of the third test image become a predetermined density, and the controller detects the streak image based on first read data corresponding to the first test image, second read data corresponding to the second test image, third read data corresponding to the third test image, and fourth read data corresponding to a non-image region of the test sheet.

2. The image forming apparatus according to claim 1, wherein an absolute value of the second charging potential is less than an absolute value of the first charging potential, and an absolute value of the second developing potential is greater than an absolute value of the first developing potential.

3. The image forming apparatus according to claim 1, wherein an absolute value of the third developing potential is greater than an absolute value of the first developing potential.

4. The image forming apparatus according to claim 1, wherein the controller is further configured to determine a unit, for which a replacement is required, of the image forming apparatus based on a result of detecting the streak image.

5. The image forming apparatus according to claim 1, wherein a length in a lengthwise direction of the first test image is shorter than a length in a lengthwise direction of the second test image, and a length in a lengthwise direction of the first test image is shorter than a length in a lengthwise direction of the third test image.

6. The image forming apparatus according to claim 1, wherein the controller is further configured to determine that a replacement of the second removing unit is required if a color of the streak image that occurs in the non-image region is a mixed color.

* * * * *